US011206888B2

(12) United States Patent
Waters

(10) Patent No.: US 11,206,888 B2
(45) Date of Patent: Dec. 28, 2021

(54) LIGHTED HEADGEAR AND ACCESSORIES THEREFOR

(71) Applicant: Waters Industries, Inc., West Dundee, IL (US)

(72) Inventor: Michael Waters, Aspen, CO (US)

(73) Assignee: Waters Industries, Inc., West Dundee, IL (US)

( * ) Notice: Subject to any disclaimer, the term of this patent is extended or adjusted under 35 U.S.C. 154(b) by 0 days.

(21) Appl. No.: 17/063,341

(22) Filed: Oct. 5, 2020

(65) Prior Publication Data

US 2021/0085010 A1 Mar. 25, 2021

Related U.S. Application Data

(63) Continuation of application No. 16/414,624, filed on May 16, 2019, now Pat. No. 10,791,783.

(51) Int. Cl.

| | |
|---|---|
| ***A42B 1/244*** | (2021.01) |
| ***F21L 4/00*** | (2006.01) |
| ***F21V 23/04*** | (2006.01) |
| ***A42B 1/0182*** | (2021.01) |
| *F21Y 115/10* | (2016.01) |
| *F21W 131/30* | (2006.01) |

(52) U.S. Cl.

CPC ..... *A42B 1/244* (2013.01); *A42B 1/0182* (2021.01); *F21L 4/00* (2013.01); *F21V 23/04* (2013.01); *F21W 2131/30* (2013.01); *F21Y 2115/10* (2016.08)

(58) Field of Classification Search

CPC ..... A42B 1/244; A42B 1/0182; F21L 4/00; F21V 23/04; F21Y 2115/10; F21W 2131/30

See application file for complete search history.

(56) References Cited

U.S. PATENT DOCUMENTS

| | | | | |
|---|---|---|---|---|
| 645,984 A ‡ | 3/1900 | Tournier | ..... | H01R 33/9555 200/51 |
| 909,742 A ‡ | 1/1909 | Borchet | ..... | H01R 33/9555 200/51 |
| 1,098,628 A ‡ | 6/1914 | Hyman | ..... | F41A 33/02 362/11 |

(Continued)

FOREIGN PATENT DOCUMENTS

| | | |
|---|---|---|
| AU | 1178576 | ‡ 9/1977 |
| AU | 6310994 | ‡ 11/1994 |

(Continued)

OTHER PUBLICATIONS

'Initial Non-Infringement, Invalidity and Unenforceability, Contentions' with Exhibit A, Exhibits B-1 and B-2, and Exhibits C-1 through C7, *Waters Industries, Inc.* v. *Outdoor Cap Co., Inc.*, United States District Court for the Northern District of Illinois, Case No. 1:13-cv-07191, 263 pages (Dec. 18, 2013).

(Continued)

*Primary Examiner* — Donald L Raleigh

(74) *Attorney, Agent, or Firm* — Fitch, Even, Tabin & Flannery LLP

(57) ABSTRACT

There is provided lighted headgear having various configurations, components thereof, and other accessories combined therewith. Also provided are a light module and a battery pack.

32 Claims, 10 Drawing Sheets

(56) References Cited

U.S. PATENT DOCUMENTS 1,109,415 A ‡ 9/1914 Harris ..... F21L 4/00 362/20
1,255,265 A ‡ 2/1918 Zachara ..... F21V 21/084 362/10
1,261,824 A ‡ 4/1918 La Vine ..... A43B 1/0036 362/10
1,323,822 A ‡ 12/1919 Bramming ..... H01R 33/955 200/51
D58,302 S ‡ 7/1921 Bartholomew ..... D2/865
1,438,586 A ‡ 12/1922 Eaton ..... F21L 4/00 200/60
1,448,353 A ‡ 3/1923 Barany ..... F21L 2/00 362/18
1,475,653 A ‡ 11/1923 Rosenberg ..... A42B 1/041 66/171
1,572,210 A ‡ 2/1926 Kolibas ..... F21V 21/084 362/10
1,615,067 A ‡ 1/1927 Boerman ..... G02C 11/04 362/10
1,744,777 A ‡ 1/1930 Lundgren ..... A42B 3/044 362/10
1,749,998 A ‡ 3/1930 Collins ..... A42B 3/044 362/10
1,879,512 A ‡ 9/1932 Rotea ..... G02C 11/04 362/10
1,883,756 A ‡ 10/1932 Bloom ..... A42B 1/066 2/172
D114,980 S ‡ 1/1939 Wengen ..... D2/865
2,196,543 A ‡ 4/1940 Anderson ..... G02C 11/04 362/25
2,373,553 A ‡ 10/1942 Fetterman ..... F21L 15/06 362/20
D137,375 S ‡ 2/1944 Heit ..... D13/15
2,369,829 A ‡ 2/1945 Johnson ..... F16M 11/22 224/18
2,461,254 A ‡ 2/1949 Bassett ..... H01J 40/02 250/22
2,473,394 A ‡ 6/1949 Scott ..... A42B 3/0433 340/32
2,531,585 A ‡ 11/1950 Pope ..... G02B 7/002 359/80
2,540,435 A ‡ 2/1951 Ferguson ..... H01H 19/001 200/56
2,552,764 A ‡ 5/1951 Bedford, Jr. ..... A44B 17/0011 24/674
2,567,046 A ‡ 9/1951 Anderson ..... F21L 2/00 340/32
2,591,112 A ‡ 4/1952 Zwierzynski ..... F21L 4/00 362/19
2,638,532 A ‡ 5/1953 Brady ..... G02C 11/04 362/10
2,640,980 A ‡ 6/1953 Prupis ..... F21V 33/00 340/32
2,705,751 A ‡ 4/1955 Harris ..... A42B 1/242 362/10
2,730,720 A ‡ 1/1956 Saunders ..... A42B 1/12 2/68
2,788,439 A ‡ 4/1957 Hesse ..... A42B 1/244 362/31
2,904,670 A ‡ 9/1959 Calmes ..... G02C 11/04 362/10
2,966,580 A ‡ 12/1960 Taylor ..... F21L 2/00 362/20
2,978,696 A ‡ 4/1961 Keller ..... A63H 37/00 340/32
3,008,040 A ‡ 11/1961 Moore ..... F21V 21/084 362/10
3,032,647 A ‡ 5/1962 Wansky ..... A42B 1/244 362/19
3,040,881 A ‡ 6/1962 McNeill ..... A47F 7/021 211/85
3,057,992 A ‡ 10/1962 Baker ..... F21L 4/00 362/20
3,060,308 A ‡ 10/1962 Fortuna ..... G02C 11/04 362/10
3,123,208 A ‡ 3/1964 Barnum et al. ..... B65D 5/5213 206/74
3,184,058 A ‡ 5/1965 Crowther ..... A47F 7/021 206/5
3,201,771 A ‡ 8/1965 Proulx ..... A42B 3/0433 340/58
D207,919 S ‡ 6/1967 Fai ..... D16/30
3,350,552 A ‡ 10/1967 Lawrence ..... F21L 14/00 362/10
3,358,137 A ‡ 12/1967 Fraser ..... A42B 3/044 362/10
3,447,164 A ‡ 6/1969 Greenhouse ..... A42B 1/12 2/68
D215,751 S ‡ 10/1969 Castellano ..... D26/38
3,491,374 A ‡ 1/1970 Frangos ..... A42B 3/28 2/171
3,535,282 A ‡ 10/1970 Rogers ..... G03B 15/03 200/60
3,537,909 A ‡ 11/1970 Horton ..... H01M 2/1044 429/98
3,602,759 A ‡ 8/1971 Evans ..... H01J 61/35 313/11
3,634,676 A ‡ 1/1972 Castellano ..... F21L 15/08 362/10
3,647,059 A ‡ 3/1972 Humphreys ..... G02C 13/006 242/56
3,666,901 A ‡ 5/1972 Weinhart ..... H01H 3/20 200/43
3,683,168 A ‡ 8/1972 Tatje ..... F21L 4/005 362/10
3,740,545 A ‡ 6/1973 Franklin ..... F21S 8/08 362/297
3,749,902 A ‡ 7/1973 Drew ..... A42B 3/0433 362/10
3,769,663 A ‡ 11/1973 Perl ..... F21V 33/0004 24/3.3
D229,975 S ‡ 1/1974 Klugman ..... D16/30
3,793,517 A ‡ 2/1974 Carlini ..... A42B 3/044 362/10
3,845,389 A ‡ 10/1974 Phillips ..... A42B 3/30 455/90
3,947,676 A ‡ 3/1976 Battilana ..... F21L 4/00 362/10
3,963,917 A ‡ 6/1976 Romano ..... A42B 1/10 362/35
4,005,776 A ‡ 2/1977 Seeley ..... B65D 75/366 206/30
4,011,600 A ‡ 3/1977 Malk ..... A42B 1/22 2/183
4,053,688 A ‡ 10/1977 Perkins ..... G04C 3/005 429/98
4,092,704 A ‡ 5/1978 Malm ..... A42B 3/044 362/10
4,176,932 A ‡ 12/1979 Young ..... G03B 15/02 348/37
4,186,429 A ‡ 1/1980 Johnston ..... A42B 3/044 362/10
4,210,952 A ‡ 7/1980 Ressmeyer ..... G03B 15/03 362/10
4,231,079 A ‡ 10/1980 Heminover ..... A42B 3/044 362/10
4,254,451 A ‡ 3/1981 Cochran, Jr. ..... A44C 15/0015 362/10
4,268,894 A ‡ 5/1981 Bartunek ..... F21L 2/00 362/15
4,270,227 A ‡ 6/1981 Wolfe ..... A41D 27/28 2/87
4,283,127 A ‡ 8/1981 Rosenwinkel ..... G02C 11/04 2/426
4,298,913 A ‡ 11/1981 Lozar ..... A42B 3/044 362/10

(56) References Cited

U.S. PATENT DOCUMENTS 4,317,162 A ‡ 2/1982 Richards ..... F21L 4/08 362/10
4,332,007 A ‡ 5/1982 Gibstein ..... F21L 2/00 362/10
4,364,107 A ‡ 12/1982 Wieczorek ..... A61B 3/024 362/28
4,392,183 A ‡ 7/1983 Ostlund ..... G03B 15/03 362/11
4,398,237 A ‡ 8/1983 Doyel ..... F21L 2/00 200/60
4,406,040 A ‡ 9/1983 Cannone ..... A42B 1/244 2/195
4,425,531 A ‡ 1/1984 Holmes ..... G03B 15/05 315/24
D272,733 S ‡ 2/1984 Cosmos ..... D13/13
4,430,532 A ‡ 2/1984 Matsumoto ..... H01H 13/14 200/34
4,442,478 A ‡ 4/1984 Stansbury ..... F21S 9/02 200/60
4,462,064 A ‡ 7/1984 Schweitzer ..... F21L 15/14 362/10
4,470,263 A ‡ 9/1984 Lehovec ..... A41D 13/0053 62/259
4,483,021 A ‡ 11/1984 McCall ..... A61F 7/10 2/7
4,516,157 A ‡ 5/1985 Campbell ..... G02C 11/00 348/15
4,521,831 A ‡ 6/1985 Thayer ..... A42B 3/044 2/422
4,541,698 A ‡ 9/1985 Lerner ..... G03B 13/02 396/37
4,551,857 A ‡ 11/1985 Galvin ..... A42B 1/008 136/29
4,553,851 A ‡ 11/1985 Matsumoto ..... G04C 10/02 368/20
4,559,516 A ‡ 12/1985 Schott ..... A42B 3/0453 340/47
4,570,206 A ‡ 2/1986 Deutsch ..... A44C 15/0015 362/10
4,602,191 A ‡ 7/1986 Davila ..... G09F 9/33 315/76
4,604,760 A ‡ 8/1986 Coin ..... A42B 5/00 2/171
4,616,297 A ‡ 10/1986 Liu ..... F21L 2/00 362/10
4,631,644 A ‡ 12/1986 Dannhauer ..... F21L 15/14 362/10
4,638,410 A ‡ 1/1987 Barker ..... B63C 11/02 128/20
4,641,647 A ‡ 2/1987 Behan ..... A61M 25/02 128/20
4,642,817 A ‡ 2/1987 Ferstenfeld ..... A42B 1/22 2/183
4,665,568 A ‡ 5/1987 Stutes ..... A42B 1/004 2/209
4,667,274 A ‡ 5/1987 Daniel ..... F21L 2/00 2/209
4,669,610 A ‡ 6/1987 Lindsey ..... B65D 75/54 206/32
4,680,815 A ‡ 7/1987 Hirsch ..... A42C 5/04 2/171
4,774,643 A ‡ 9/1988 McGinnis ..... F21L 2/00 362/18
4,794,496 A ‡ 12/1988 Lanes ..... F21L 4/08 362/10
4,817,212 A ‡ 4/1989 Benoit ..... A42B 1/244 362/10
4,822,160 A ‡ 4/1989 Tsai ..... G02C 11/04 351/15
4,822,161 A ‡ 4/1989 Jimmy ..... G02C 11/04 351/15
4,827,384 A ‡ 5/1989 Von Schlemmer .... A42B 1/241 362/10
4,829,285 A ‡ 5/1989 Brand ..... G08B 21/0446 340/52
4,872,218 A ‡ 10/1989 Holt ..... A42B 1/225 2/171
4,875,147 A ‡ 10/1989 Auer ..... F21L 4/00 362/20
4,884,067 A ‡ 11/1989 Nordholm ..... G08B 13/02 340/68
4,901,210 A ‡ 2/1990 Hanabusa ..... A42B 3/044 2/422
4,901,211 A ‡ 2/1990 Shen ..... G09F 21/02 362/10
4,902,119 A ‡ 2/1990 Porsche ..... G02C 5/122 351/13
4,904,078 A ‡ 2/1990 Gorike ..... G02C 11/06 351/15
4,920,466 A ‡ 4/1990 Liu ..... A61H 23/0263 362/10
4,945,458 A ‡ 7/1990 Batts ..... A42B 3/044 2/906
4,951,068 A ‡ 8/1990 Ichikawa ..... G03B 7/16 396/17
4,959,760 A ‡ 9/1990 Wu ..... F21L 14/00 362/10
4,963,045 A ‡ 10/1990 Willcox ..... A45D 34/04 206/44
4,969,069 A ‡ 11/1990 Eichost ..... F21V 21/084 362/10
4,991,068 A ‡ 2/1991 Mickey ..... A42B 1/244 362/44
4,998,187 A ‡ 3/1991 Herrick ..... A42B 3/044 224/18
5,003,640 A ‡ 4/1991 Pizzacar ..... A42B 1/248 2/181
D316,932 S ‡ 5/1991 Escher, Jr. ..... D3/265
5,039,829 A ‡ 8/1991 Brucksch ..... H01H 9/286 200/43
5,060,814 A ‡ 10/1991 Oglesbee ..... B65D 71/00 220/83
5,068,771 A ‡ 11/1991 Savage, Jr. ..... F21S 8/00 362/25
5,070,436 A ‡ 12/1991 Alexander ..... A41D 13/01 362/10
5,088,127 A ‡ 2/1992 Thornock ..... A42B 1/004 2/209
5,111,366 A ‡ 5/1992 Rife ..... G02B 6/0095 362/60
5,113,325 A ‡ 5/1992 Eisenbraun ..... A41D 27/085 362/10
5,117,510 A ‡ 6/1992 Broussard ..... A45F 5/00 2/171
5,122,943 A ‡ 6/1992 Pugh ..... H01L 33/54 362/25
5,138,538 A ‡ 8/1992 Sperling ..... F21L 4/00 200/60
5,140,116 A ‡ 8/1992 Schmitt-Walter ..... H01H 9/162 200/27
5,140,220 A ‡ 8/1992 Hasegawa ..... H01L 33/54 313/51
5,143,443 A ‡ 9/1992 Madsen ..... F21V 3/04 313/63
5,158,356 A ‡ 10/1992 Guthrie ..... F21L 4/005 362/18
5,163,420 A ‡ 11/1992 Van Der Bel ..... F21L 14/00 362/10
5,164,749 A ‡ 11/1992 Shelton ..... G02C 9/04 351/47
5,165,789 A ‡ 11/1992 Womack ..... F21L 14/02 362/39
5,183,326 A ‡ 2/1993 Case ..... A61F 9/029 224/18
5,189,512 A ‡ 2/1993 Cameron ..... G02B 27/0172 348/83

(56) References Cited

U.S. PATENT DOCUMENTS 5,193,220 A ‡ 3/1993 Ichinohe ..... H03J 1/00 455/34
5,193,347 A ‡ 3/1993 Apisdorf ..... A42B 3/285 2/171
5,207,500 A ‡ 5/1993 Rios ..... A42B 3/0446 340/47
5,218,385 A ‡ 6/1993 Lii ..... G02C 11/04 351/15
5,224,772 A ‡ 7/1993 Fustos ..... B63C 11/12 2/428
5,230,558 A ‡ 7/1993 Jong ..... F21L 15/14 362/10
5,238,344 A ‡ 8/1993 Nagayama ..... F16B 37/048 411/11
5,245,516 A ‡ 9/1993 de Haas ..... F21L 2/00 362/10
5,249,675 A ‡ 10/1993 Strauss ..... A45C 11/04 206/21
D343,470 S ‡ 1/1994 Yuen ..... D26/46
5,278,734 A ‡ 1/1994 Ferber ..... G09F 21/02 362/10
D349,123 S ‡ 7/1994 Cooley ..... D16/30
5,329,637 A ‡ 7/1994 Walker ..... A42B 3/044 2/5
5,331,333 A ‡ 7/1994 Tagawa ..... G09F 9/33 345/31
5,331,357 A ‡ 7/1994 Cooley ..... G02B 6/0008 351/15
5,353,205 A ‡ 10/1994 Hudak ..... A42B 3/0446 2/200
5,357,409 A ‡ 10/1994 Glatt ..... A42B 3/044 362/10
5,363,291 A ‡ 11/1994 Steiner ..... G09F 21/02 362/19
5,367,345 A ‡ 11/1994 da Silva ..... G02C 11/10 351/12
5,404,593 A ‡ 4/1995 Kronenberger ..... A42B 1/248 2/195
5,408,393 A ‡ 4/1995 Becker ..... A42B 3/044 362/10
5,410,746 A ‡ 4/1995 Gelber ..... A42B 1/245 2/209
5,412,545 A ‡ 5/1995 Rising ..... A42B 1/244 2/209
5,418,565 A ‡ 5/1995 Smith ..... H04N 5/232933 348/27
5,423,419 A ‡ 6/1995 Wentz ..... A45C 11/04 206/6
5,425,620 A ‡ 6/1995 Stroud ..... A42B 1/008 416/63
5,438,698 A ‡ 8/1995 Burton ..... H01Q 1/276 2/209
5,452,190 A ‡ 9/1995 Priesemuth ..... G09F 13/22
5,460,346 A ‡ 10/1995 Hirsch ..... A45F 5/02 224/27
5,463,538 A ‡ 10/1995 Womack ..... A42B 1/244 362/10
5,467,992 A ‡ 11/1995 Harkness ..... A42B 1/242 473/40
5,485,358 A ‡ 1/1996 Chien ..... A42B 1/244 362/10
5,488,361 A ‡ 1/1996 Perry ..... A42B 3/044 340/69
5,503,637 A ‡ 4/1996 Kyricos ..... A61M 21/00 600/27
5,508,900 A ‡ 4/1996 Norman ..... A42B 3/0406 2/422
5,510,961 A ‡ 4/1996 Peng ..... A42B 1/242 2/209
5,541,767 A ‡ 7/1996 Murphy ..... G02B 7/002 351/15
5,541,816 A ‡ 7/1996 Miserendino ..... A42B 1/244 362/10
5,542,627 A ‡ 8/1996 Crenshaw ..... A42B 3/04 2/6.3
5,546,099 A ‡ 8/1996 Quint ..... G02B 27/0172 128/85
5,564,128 A ‡ 10/1996 Richardson ..... A42B 3/044 2/422
5,567,038 A ‡ 10/1996 Lary ..... A42B 1/244 362/10
D375,372 S ‡ 11/1996 Allen ..... D26/37
5,575,554 A ‡ 11/1996 Guritz ..... A41D 27/085 362/10
5,601,358 A ‡ 2/1997 Chien ..... F21L 4/00 248/91
5,606,743 A ‡ 2/1997 Vogt ..... H04B 1/086 16/228
5,608,808 A ‡ 3/1997 da Silva ..... G02C 11/10 351/12
5,610,678 A ‡ 3/1997 Tsuboi ..... G03B 13/02 396/37
5,644,189 A ‡ 7/1997 Busby ..... H01K 1/44 313/31
5,655,374 A ‡ 8/1997 Santilli ..... A41D 13/1218 2/905
D383,754 S ‡ 9/1997 Yuen ..... D14/16
D383,863 S ‡ 9/1997 Yuen ..... D26/46
5,667,291 A ‡ 9/1997 Caplan ..... F21V 21/084 362/10
5,667,292 A ‡ 9/1997 Sabalvaro, Jr. ..... A42B 1/244 2/10
5,676,449 A ‡ 10/1997 Newsome ..... A42B 1/244 362/10
5,677,079 A ‡ 10/1997 DeZorzi ..... H01M 2/105 429/99
5,680,718 A ‡ 10/1997 Ratcliffe ..... A42B 1/248 2/195
5,688,039 A ‡ 11/1997 Johnson ..... A42B 3/0446 362/10
D388,113 S ‡ 12/1997 Feinbloom ..... D16/30
5,692,244 A ‡ 12/1997 Johnson ..... A42B 1/062 2/181
5,708,449 A ‡ 1/1998 Heacock ..... G02B 7/12 345/7
5,709,464 A ‡ 1/1998 Tseng ..... A42B 1/242 36/137
5,718,335 A ‡ 2/1998 Boudreaux ..... B65D 75/52 206/46
5,722,762 A ‡ 3/1998 Soll ..... F21L 15/14 362/10
5,730,290 A ‡ 3/1998 Futo ..... B65D 75/32 206/34
5,741,060 A ‡ 4/1998 Johnson ..... A42B 1/244 362/10
5,743,621 A ‡ 4/1998 Mantha ..... A42B 3/044 362/10
5,758,947 A ‡ 6/1998 Glatt ..... A42B 3/044 362/10
5,774,338 A ‡ 6/1998 Wessling, III ..... G06F 1/163 361/73
5,786,665 A ‡ 7/1998 Ohtsuki ..... G02B 6/0021 313/51
5,800,278 A ‡ 9/1998 Varriano ..... A63B 69/3608 473/20
5,806,961 A ‡ 9/1998 Dalton ..... F21L 4/025 362/18
5,822,636 A ‡ 10/1998 Cho ..... G03B 17/38 396/42
5,829,063 A ‡ 11/1998 Cheng ..... A42B 1/248 2/209
5,829,860 A ‡ 11/1998 Lawther ..... G03B 15/03 362/11
5,836,673 A ‡ 11/1998 Lo ..... A41D 13/01 362/18
5,845,778 A ‡ 12/1998 Hickey, Jr. ..... B65D 75/36 206/45

(56) References Cited

U.S. PATENT DOCUMENTS 5,845,987 A ‡ 12/1998 Painter ..... A42B 1/242 362/20
5,857,220 A ‡ 1/1999 Erny ..... A41D 27/08 2/209
5,865,333 A ‡ 2/1999 Wolfe ..... A45C 11/02 220/4
5,871,271 A ‡ 2/1999 Chien ..... A42B 3/044 362/10
D407,187 S ‡ 3/1999 Makki ..... D2/866
5,876,241 A ‡ 3/1999 Frantz ..... H01M 2/1044 439/50
5,893,631 A ‡ 4/1999 Padden ..... F21L 15/06 362/11
5,894,604 A ‡ 4/1999 Crabb ..... A42B 1/241 2/209
5,911,494 A 6/1999 Lary
5,918,966 A ‡ 7/1999 Arnold ..... H01K 1/26 361/77
5,920,910 A ‡ 7/1999 Calvo ..... A42C 5/02 2/181
5,921,674 A ‡ 7/1999 Koczi ..... A41D 27/085 362/80
5,922,489 A ‡ 7/1999 Adachi ..... H01M 4/52 429/10
5,931,693 A ‡ 8/1999 Yamazaki ..... H01R 13/2492 439/50
5,946,071 A ‡ 8/1999 Feldman ..... G02C 11/04 351/15
5,982,969 A ‡ 11/1999 Sugiyama ..... B60Q 1/26 362/55
5,997,165 A ‡ 12/1999 Lehrer ..... F21L 15/02 362/10
6,005,536 A ‡ 12/1999 Beadles ..... G02B 27/017 345/7
6,007,212 A ‡ 12/1999 Chan ..... A42B 1/004 362/10
6,007,213 A ‡ 12/1999 Baumgartner ..... A42B 3/044 362/10
6,009,563 A ‡ 1/2000 Swanson ..... A42B 3/044 2/422
6,012,822 A ‡ 1/2000 Robinson ..... A43B 1/0036 315/20
6,012,827 A ‡ 1/2000 Caplan ..... F21L 15/14 362/10
D420,035 S ‡ 2/2000 Hartman ..... D16/32
D420,207 S ‡ 2/2000 Barton ..... D2/865
6,021,525 A ‡ 2/2000 Mertins ..... A42B 1/067 2/172
6,023,788 A ‡ 2/2000 McCallum ..... A42B 1/241 2/181
6,028,627 A ‡ 2/2000 Helmsderfer ..... G03B 17/561 348/15
6,032,291 A ‡ 3/2000 Asenguah ..... A42B 1/008 2/171
6,032,293 A ‡ 3/2000 Makki ..... A42B 1/242 2/195
6,056,413 A ‡ 5/2000 Urso ..... A42B 1/244 362/10
D428,431 S ‡ 7/2000 Jordan ..... D16/30
6,086,214 A ‡ 7/2000 Ridge ..... F21S 9/026 362/19
6,087,037 A ‡ 7/2000 Rieder ..... H01M 2/1044 429/99
6,088,053 A ‡ 7/2000 Hammack ..... G02B 23/18 348/61
6,094,749 A ‡ 8/2000 Proctor ..... A42B 1/004 2/171
6,113,243 A ‡ 9/2000 Saul ..... A42B 3/0453 345/8
6,113,244 A ‡ 9/2000 Baumgartner ..... A42B 3/044 362/10
6,116,745 A ‡ 9/2000 Yei ..... G09F 21/02 362/10
6,124,056 A ‡ 9/2000 Kimura ..... H01M 2/1044 429/10
6,126,294 A ‡ 10/2000 Koyama ..... A61M 21/00 362/10
6,167,570 B1 ‡ 1/2001 Su ..... A42B 1/248 2/209
6,168,286 B1 ‡ 1/2001 Duffy ..... A42B 1/242 362/10
6,172,657 B1 ‡ 1/2001 Kamakura ..... G06F 1/163 345/8
6,174,075 B1 ‡ 1/2001 Fuwausa ..... A41D 27/085 362/10
6,176,601 B1 ‡ 1/2001 Nester ..... B60Q 1/2657 362/28
6,206,543 B1 ‡ 3/2001 Henry ..... A45F 5/02 362/10
6,236,007 B1 ‡ 5/2001 Ho ..... H01H 9/0228 200/56
6,237,147 B1 ‡ 5/2001 Brockman ..... A42B 1/247 2/10
6,240,566 B1 ‡ 6/2001 Scantlin ..... A42B 1/225 2/171
6,244,721 B1 ‡ 6/2001 Rodriguez ..... A42B 3/044 362/10
6,250,769 B1 ‡ 6/2001 Kirk ..... A42B 1/244 362/10
D445,928 S ‡ 7/2001 Sharrah ..... F21L 4/00 D26/38
6,256,795 B1 ‡ 7/2001 Habel ..... A42B 1/004 2/209
D446,324 S ‡ 8/2001 Lynch ..... D26/37
6,290,368 B1 ‡ 9/2001 Lehrer ..... F21V 21/0885 362/18
6,299,323 B1 ‡ 10/2001 Yu ..... F21L 4/005 362/11
6,302,570 B1 ‡ 10/2001 Petell ..... A42B 1/248 362/55
6,306,538 B1 ‡ 10/2001 Saitoh ..... H01M 2/1044 429/96
6,307,526 B1 ‡ 10/2001 Mann ..... H04N 5/2254 345/8
6,311,350 B1 ‡ 11/2001 Kaiserman ..... A47G 9/1045 174/12
6,311,837 B1 ‡ 11/2001 Blaustein ..... B65D 75/36 15/28
6,320,822 B1 ‡ 11/2001 Okeya ..... G04G 19/12 368/66
6,325,521 B1 ‡ 12/2001 Gregg ..... A42B 3/0433 362/10
6,328,454 B1 ‡ 12/2001 Davis ..... A42B 3/044 362/10
6,340,234 B1 ‡ 1/2002 Brown, Jr. ..... A61F 9/06 362/10
6,345,716 B1 ‡ 2/2002 Chapman ..... B65D 75/32 206/45
6,347,410 B1 ‡ 2/2002 Lee ..... A42B 1/22 2/181
6,363,537 B1 ‡ 4/2002 Park ..... A42B 1/22 2/181
6,366,344 B1 ‡ 4/2002 Lach ..... F41G 1/35 33/265
6,367,949 B1 ‡ 4/2002 Pederson ..... B60Q 1/2611 362/24
D457,670 S ‡ 5/2002 Allen ..... D26/37
6,382,407 B1 ‡ 5/2002 Chao ..... A45C 11/04 206/5
6,386,701 B1 ‡ 5/2002 Khulusi ..... G02C 5/001 351/15
6,390,640 B1 ‡ 5/2002 Wong ..... B63C 11/12 351/14
6,398,386 B1 ‡ 6/2002 Huang ..... F21V 19/0005 362/24
6,416,199 B1 ‡ 7/2002 Heine ..... B63C 11/12 351/15

(56) References Cited

U.S. PATENT DOCUMENTS 6,431,904 B1 ‡ 8/2002 Berelsman ..... H01R 13/5845 439/34
6,439,738 B1 ‡ 8/2002 Matthews ..... F21L 4/02 362/18
6,442,764 B1 ‡ 9/2002 Badillo ..... A42B 1/244 2/175
6,457,838 B1 ‡ 10/2002 Dugmore ..... F21L 15/14 362/10
6,461,015 B1 ‡ 10/2002 Welch ..... A42B 1/242 362/10
6,461,025 B1 ‡ 10/2002 Payne ..... F21V 15/01 362/36
6,474,830 B1 ‡ 11/2002 Hansen ..... A44B 1/04 362/10
6,476,391 B1 ‡ 11/2002 Zhang ..... G02B 1/02 250/33
6,497,493 B1 ‡ 12/2002 Theisen ..... A42B 3/044 2/422
D469,198 S ‡ 1/2003 Olson ..... D10/11
6,504,099 B2 ‡ 1/2003 Huang ..... H01R 33/09 174/74
6,523,973 B2 ‡ 2/2003 Galli ..... F21L 4/005 362/11
6,530,672 B2 ‡ 3/2003 Galli ..... F21L 4/005 362/11
6,538,567 B2 ‡ 3/2003 Stewart ..... B60Q 1/34 340/47
D473,890 S ‡ 4/2003 Waters ..... D16/30
6,549,231 B1 ‡ 4/2003 Matsui ..... H04N 7/183 348/15
6,553,570 B1 ‡ 4/2003 Flynn ..... G02C 3/02 2/10
6,554,444 B2 ‡ 4/2003 Shimada ..... F21L 15/14 362/10
6,578,982 B1 ‡ 6/2003 Lynch ..... A44C 15/0015 362/10
D477,432 S ‡ 7/2003 Parsons ..... D26/37
6,598,991 B2 ‡ 7/2003 Altman ..... A44B 15/005 362/10
6,604,837 B2 ‡ 8/2003 Sandberg ..... A45F 5/02 362/10
6,612,695 B2 ‡ 9/2003 Waters ..... F21V 21/084 351/15
6,612,696 B2 ‡ 9/2003 Waters ..... F21V 21/0885 351/15
6,616,293 B2 ‡ 9/2003 Mickey ..... A42B 1/244 362/10
6,634,031 B1 ‡ 10/2003 Schlapkohl ..... A42B 1/242 2/209
6,642,667 B2 ‡ 11/2003 Avis ..... F21L 4/005 315/20
D483,928 S ‡ 12/2003 Mansell ..... D2/871
6,659,618 B2 ‡ 12/2003 Waters ..... G02C 11/04 362/10
D484,905 S ‡ 1/2004 Waters ..... D16/30
6,679,615 B2 ‡ 1/2004 Spearing ..... A41D 13/01 340/47
6,704,044 B1 ‡ 3/2004 Foster ..... A42B 1/24 348/15
6,709,142 B2 ‡ 3/2004 Gyori ..... A41D 19/0157 362/10
6,713,956 B2 ‡ 3/2004 Hsing Chen ..... G09F 9/33 313/51
6,715,309 B1 ‡ 4/2004 Junkins ..... A42B 3/285 62/259
6,719,437 B2 ‡ 4/2004 Lary ..... A42B 1/244 2/209
6,721,962 B1 ‡ 4/2004 Polaire ..... A42B 1/244 2/209
D489,165 S ‡ 5/2004 Waters ..... D2/866
6,733,150 B1 ‡ 5/2004 Hanley ..... A42B 1/244 2/209
6,749,166 B2 ‡ 6/2004 Valentine ..... F16M 11/40 24/115
6,760,925 B1 ‡ 7/2004 Maxwell ..... A42B 3/285 2/171
6,764,194 B1 ‡ 7/2004 Cooper ..... F21V 21/084 362/10
6,802,636 B1 ‡ 10/2004 Bailey, Jr. ..... A63C 17/01 280/84
6,808,284 B1 ‡ 10/2004 Chao ..... G02C 11/04 362/10
6,811,441 B2 ‡ 11/2004 Simpson ..... H01R 13/5845 439/60
6,817,711 B2 ‡ 11/2004 Schubert ..... A42B 1/247 351/15
6,830,357 B2 ‡ 12/2004 Lopez ..... B60Q 1/2661 362/12
D501,266 S ‡ 1/2005 Harris, Jr. ..... D26/37
6,837,590 B2 ‡ 1/2005 Marston ..... A42B 1/244 362/10
6,857,739 B1 ‡ 2/2005 Watson ..... G02C 11/04 351/15
6,860,628 B2 ‡ 3/2005 Robertson ..... H05B 45/37 362/55
6,863,416 B2 ‡ 3/2005 Waters ..... F21V 21/0885 362/10
6,865,285 B1 ‡ 3/2005 Villa-Aleman .... G06K 9/00013 362/10
6,880,989 B2 ‡ 4/2005 Sotome ..... G03B 21/28 200/34
6,908,208 B1 ‡ 6/2005 Hyde ..... F21L 4/06 362/10
D507,368 S ‡ 7/2005 Waters ..... D26/37
D507,369 S ‡ 7/2005 Waters ..... D26/37
6,918,678 B2 ‡ 7/2005 McClanahan ..... F21V 33/0052 362/10
6,923,322 B2 ‡ 8/2005 Lenker ..... A47G 25/10 206/45
6,929,375 B2 ‡ 8/2005 Satomi ..... G03B 27/542 362/11
6,929,878 B2 ‡ 8/2005 Chen ..... H01M 2/1066 429/10
6,932,216 B2 ‡ 8/2005 Blaustein ..... A61C 17/22 15/22
6,935,761 B2 ‡ 8/2005 Vanderschuit ..... A42B 1/062 362/10
6,941,583 B2 ‡ 9/2005 Yan ..... A42B 3/044 2/209
6,966,668 B2 ‡ 11/2005 Cugini ..... F21L 14/00 362/10
6,969,178 B2 ‡ 11/2005 Zuloff ..... A42B 1/004 2/209
6,977,776 B2 ‡ 12/2005 Volkenandt ..... G02B 27/0172 359/63
6,993,803 B2 ‡ 2/2006 Chan ..... A61C 17/22 15/22
6,994,445 B1 ‡ 2/2006 Pomes ..... A42B 1/242 2/209
6,997,552 B1 ‡ 2/2006 Hung ..... G02C 11/02 351/15
7,000,841 B2 ‡ 2/2006 Becker ..... A42B 1/244 235/46
7,003,353 B1 ‡ 2/2006 Parkhouse ..... A61N 1/3787 607/45
7,004,439 B1 ‡ 2/2006 Taylor ..... A42B 3/04 248/54
7,004,582 B2 ‡ 2/2006 Jannard ..... G02C 11/06 351/15
7,008,074 B1 ‡ 3/2006 Halm ..... A61B 1/24 362/10
7,021,790 B2 ‡ 4/2006 Parsons ..... A44B 15/005 362/11
D520,460 S ‡ 5/2006 Wadsworth ..... D13/15
7,052,154 B2 ‡ 5/2006 Vanderschuit ..... A42B 1/062 362/10
7,055,179 B2 ‡ 6/2006 Warner ..... A42B 1/041 2/174

(56) References Cited

U.S. PATENT DOCUMENTS 7,086,749 B1 ‡ 8/2006 Hanley ..... A42B 1/244 362/10
7,094,981 B2 ‡ 8/2006 Sorrentino ..... A61C 17/221 15/22
7,104,670 B2 ‡ 9/2006 Waters ..... F21V 21/084 362/20
7,105,939 B2 ‡ 9/2006 Bednyak ..... B63J 3/04 290/42
7,111,956 B2 ‡ 9/2006 Brown ..... A42B 1/244 2/209
7,114,823 B2 ‡ 10/2006 McCullough ..... F21V 33/0056 362/10
7,118,241 B2 ‡ 10/2006 Sohn ..... A42B 1/244 362/10
7,118,262 B2 ‡ 10/2006 Negley ..... H01L 33/58 362/55
7,128,434 B1 ‡ 10/2006 Nally ..... A42B 3/044 362/10
7,143,451 B2 ‡ 12/2006 Lundgren ..... A42B 3/28 2/171
7,147,324 B2 ‡ 12/2006 Jannard ..... G02C 11/06 351/15
7,147,338 B2 ‡ 12/2006 Gregg ..... A42B 3/044 362/10
7,150,526 B2 ‡ 12/2006 Jannard ..... G02B 27/0176 351/15
7,163,309 B2 ‡ 1/2007 Sohn ..... A42B 1/244 2/906
7,182,478 B2 ‡ 2/2007 Marston ..... A43B 1/0036 2/209
7,186,159 B1 ‡ 3/2007 Baxter ..... A42B 1/12 2/422
7,192,151 B2 ‡ 3/2007 Clupper ..... A42B 3/044 2/171
7,209,652 B2 ‡ 4/2007 Uenaka ..... G03B 15/03 362/11
7,213,917 B2 ‡ 5/2007 Jannard ..... G02C 11/06 351/15
7,216,973 B2 ‡ 5/2007 Jannard ..... G02C 11/06 351/15
7,234,831 B1 ‡ 6/2007 Hanley ..... A42B 1/244 2/209
7,226,180 B2 ‡ 7/2007 Sung ..... A63B 33/002 362/10
7,255,437 B2 ‡ 8/2007 Howell ..... G02C 5/001 351/15
7,264,350 B2 ‡ 9/2007 Jannard ..... G02C 11/06 351/15
D553,177 S ‡ 10/2007 Chen ..... D16/30
7,278,734 B2 ‡ 10/2007 Jannard ..... G02C 3/003 351/15
7,281,826 B2 ‡ 10/2007 Huang ..... F21V 21/084 362/10
7,318,654 B2 ‡ 1/2008 McClanahan ..... F21V 33/0052 362/10
7,331,064 B1 ‡ 2/2008 Quintal ..... A42B 1/008 2/171
D566,044 S ‡ 4/2008 D'Arco ..... D13/13
D568,922 S ‡ 5/2008 Anderl ..... D16/32
7,369,174 B2 ‡ 5/2008 Olita ..... G02B 27/0176 348/37
7,377,664 B2 ‡ 5/2008 Waters ..... F21V 21/0885 362/10
7,377,666 B1 ‡ 5/2008 Tyler ..... A61F 11/14 362/10
7,427,149 B2 ‡ 9/2008 Sohn ..... F21S 9/037 362/10
7,431,472 B2 ‡ 10/2008 Becker ..... A42B 1/244 362/10
7,438,409 B2 ‡ 10/2008 Jordan ..... G02C 11/04 351/15
7,457,536 B2 ‡ 11/2008 Hamada ..... G03B 15/05 348/37
7,461,764 B2 ‡ 12/2008 Thompson ..... A42B 1/002 2/209
7,466,040 B2 ‡ 12/2008 Bruwer ..... H05B 47/105 307/11
7,470,022 B2 ‡ 12/2008 Lerner ..... F21V 1/247 2/209
7,506,992 B2 ‡ 3/2009 Carter ..... F21L 4/00 2/209
D591,675 S ‡ 5/2009 Waters ..... D13/11
7,562,979 B2 ‡ 7/2009 Waters ..... G02C 11/04 351/15
7,576,800 B2 ‡ 8/2009 Swain ..... H04N 5/77 348/37
D600,208 S ‡ 9/2009 Waters ..... D13/11
D600,738 S ‡ 9/2009 Su ..... D16/30
7,598,928 B1 ‡ 10/2009 Buskop ..... H04N 7/163 345/7
7,607,775 B2 ‡ 10/2009 Hermanson ..... G02C 11/04 351/11
7,609,295 B2 ‡ 10/2009 Aridome ..... H04N 5/772 348/22
7,611,255 B1 ‡ 11/2009 Lagassey ..... A42B 1/244 362/10
7,621,000 B1 ‡ 11/2009 Fulton ..... A42B 1/24 2/195
D605,381 S ‡ 12/2009 Mastrantonio ..... D2/891
7,661,818 B2 ‡ 2/2010 Waters ..... F21V 21/0885 351/15
D611,086 S ‡ 3/2010 Meng-Suen ..... D16/30
7,677,751 B2 ‡ 3/2010 Kinsman ..... F21V 33/0048 362/10
7,699,486 B1 ‡ 4/2010 Beiner ..... G02C 11/04 362/10
D617,826 S ‡ 6/2010 Waters ..... D16/30
7,753,547 B2 ‡ 7/2010 Waters ..... A42B 1/244 362/10
7,755,219 B2 ‡ 7/2010 Bruwer ..... H05B 47/14 307/11
7,784,960 B2 ‡ 8/2010 Lahtinen ..... A42B 3/044 362/10
7,862,979 B2 ‡ 1/2011 Morris ..... G03G 9/0804 430/13
7,934,846 B1 ‡ 5/2011 Schwanz ..... F21L 4/04 362/10
7,938,553 B1 ‡ 5/2011 Beiner ..... G02C 11/04 362/10
7,942,543 B2 ‡ 5/2011 Ritter ..... A42B 1/244 362/10
8,002,437 B2 ‡ 8/2011 Sohn ..... F21L 4/04 362/24
8,075,153 B2 ‡ 12/2011 Werner ..... F21V 33/0064 362/10
8,141,395 B2 ‡ 3/2012 Dillavou ..... D04B 7/08 66/171
8,157,403 B2 ‡ 4/2012 Lau ..... F21V 21/0885 362/10
D659,351 S ‡ 5/2012 Benkendorfer ..... D2/865
8,277,069 B2 ‡ 10/2012 Zuloff ..... A42B 1/244 362/10
8,333,485 B2 ‡ 12/2012 Waters ..... A42B 1/244 362/10
8,364,220 B2 ‡ 1/2013 Sandmore ..... A42B 1/242 600/32
8,388,164 B2 ‡ 3/2013 Waters ..... A42B 1/244 362/10
8,491,145 B2 ‡ 7/2013 Waters ..... A42B 1/244 362/10
8,550,651 B2 ‡ 10/2013 Waters ..... F21L 4/027 362/10
8,698,027 B2 ‡ 4/2014 Anderst ..... H01H 13/14 200/34
8,757,831 B2 ‡ 6/2014 Waters ..... A42B 1/245 362/10

(56) References Cited

U.S. PATENT DOCUMENTS 8,757,931 B2 ‡ 6/2014 Puttmann ..... F16L 55/18 405/18
8,769,723 B1 ‡ 7/2014 Ilges ..... A42B 1/068 2/172
8,774,420 B2 ‡ 7/2014 Belafonte ..... H04R 1/2811 381/74
8,813,268 B1 ‡ 8/2014 Fitzgerald ..... A42B 1/24 2/422
8,919,984 B1 ‡ 12/2014 Fitzgerald ..... A42B 1/244 362/10
8,950,012 B2 ‡ 2/2015 Ilges ..... A42B 1/046 2/9
9,057,500 B2 ‡ 6/2015 Opolka ..... F21L 4/005
D734,925 S ‡ 7/2015 Waters ..... D2/891
9,101,174 B2 ‡ 8/2015 Waters ..... A42B 1/004
9,526,287 B2 ‡ 12/2016 Waters ..... A42B 1/244
9,609,902 B2 ‡ 4/2017 Waters ..... A42B 1/24
9,872,530 B2 ‡ 1/2018 Waters ..... A42B 1/244
10,117,476 B2 ‡ 11/2018 Waters ..... F21V 33/0008
10,159,294 B2 ‡ 12/2018 Waters ..... A42B 1/244
2001/0024365 A1 ‡ 9/2001 Aknine ..... A42B 1/244 362/10
2002/0027777 A1 ‡ 3/2002 Takasu ..... F21V 23/0414 362/10
2002/0129989 A1 ‡ 9/2002 Parsons ..... A61B 7/04 181/13
2002/0131275 A1 ‡ 9/2002 Yamamoto ..... F21S 9/043 362/55
2002/0159250 A1 ‡ 10/2002 Kuo ..... A42B 3/044 362/10
2002/0163800 A1 ‡ 11/2002 Hansen ..... A44B 1/04 362/10
2002/0186557 A1 ‡ 12/2002 Lary ..... F21V 21/0832 362/10
2002/0187806 A1 ‡ 12/2002 Jang ..... H04B 1/3838 455/55
2003/0079387 A1 ‡ 5/2003 Derose ..... G02B 6/0083 40/544
2003/0086053 A1 ‡ 5/2003 Waters ..... G02C 11/04 351/15
2003/0086054 A1 ‡ 5/2003 Waters ..... F21V 21/084 351/15
2003/0106918 A1 ‡ 6/2003 Hung ..... A45F 5/02 224/22
2003/0122958 A1 ‡ 7/2003 Olita ..... G02B 27/0176 348/37
2003/0151910 A1 ‡ 8/2003 Marston ..... A42B 1/244 362/10
2003/0169207 A1 ‡ 9/2003 Beigel ..... H01Q 1/22 343/71
2003/0189824 A1 ‡ 10/2003 Meeder ..... G02C 11/04 362/10
2003/0206269 A1 ‡ 11/2003 Waters ..... F21V 21/084 351/15
2003/0231489 A1 ‡ 12/2003 Hsiao ..... F21V 21/096 362/10
2004/0001150 A1 ‡ 1/2004 Schindler, II ..... H04N 1/2116 348/22
2004/0008157 A1 ‡ 1/2004 Brubaker ..... G02B 27/017 345/8
2004/0085745 A1 ‡ 5/2004 Yoshihara ..... H04N 5/2256 362/8
2004/0128737 A1 ‡ 7/2004 Gesten ..... A42B 1/245 2/171
2004/0141312 A1 ‡ 7/2004 Henning ..... F21V 21/084 362/10
2004/0141316 A1 ‡ 7/2004 Twardawski ..... F21L 4/027 362/18
2004/0165109 A1 ‡ 8/2004 Lee ..... H04N 5/2251 348/37
2004/0222638 A1 ‡ 11/2004 Bednyak ..... H02K 7/1892 290/1 R
2004/0240067 A1 ‡ 12/2004 Marusi ..... G02B 5/283 359/58
2004/0240204 A1 ‡ 12/2004 Russ ..... A42B 3/0433 362/23
2004/0252487 A1 ‡ 12/2004 McCullough ..... F21V 33/0056 362/10
2004/0264173 A1 ‡ 12/2004 Vanderschuit ..... G09F 21/02 362/10
2004/0264176 A1 ‡ 12/2004 Vanderschuit ..... A42B 1/244 362/10
2005/0001433 A1 ‡ 1/2005 Seelin ..... G09F 21/048 290/44
2005/0035925 A1 ‡ 2/2005 Ostromek ..... G02B 27/017 345/8
2005/0047116 A1 ‡ 3/2005 Gagne ..... A62B 18/08 362/10
2005/0066422 A1 ‡ 3/2005 Yan ..... A42B 1/244 2/209
2005/0072458 A1 ‡ 4/2005 Goldstein ..... H01G 9/2068 136/25
2005/0078473 A1 ‡ 4/2005 Zuloff ..... A42B 1/004 362/10
2005/0083676 A1 ‡ 4/2005 VanderSchuit ..... A61J 17/1012 362/84
2005/0099799 A1 ‡ 5/2005 Cugini ..... G02C 11/04 362/10
2005/0105285 A1 ‡ 5/2005 Maden ..... A42B 3/044 362/10
2005/0161313 A1 ‡ 7/2005 Sorrentino ..... A61C 17/221 200/33
2005/0174753 A1 ‡ 8/2005 Cao ..... F21V 29/74 362/10
2005/0204490 A1 ‡ 9/2005 Kemp ..... F03G 7/08 15/22
2005/0211187 A1 ‡ 9/2005 Harman ..... A01K 15/023 119/72
2005/0211574 A1 ‡ 9/2005 Reeve ..... B65D 85/18 206/8
2005/0213340 A1 ‡ 9/2005 Suzuki ..... F21S 41/36 362/53
2005/0219837 A1 ‡ 10/2005 Brown ..... A42B 1/244 362/10
2005/0226433 A1 ‡ 10/2005 McClanahan ..... F21V 33/0052 381/71
2005/0237479 A1 ‡ 10/2005 Rose ..... G02B 27/017 351/12
2005/0248932 A1 ‡ 11/2005 Waters ..... G02C 9/04 362/10
2005/0254238 A1 ‡ 11/2005 Parker ..... F21V 21/0885 362/19
2005/0265015 A1 ‡ 12/2005 Salazar ..... A42B 3/044 362/10
2006/0012974 A1 ‡ 1/2006 Su ..... G02C 11/04 362/10
2006/0012975 A1 ‡ 1/2006 Huttner ..... G02C 11/04 362/10
2006/0037125 A1 ‡ 2/2006 McDowell ..... G02B 7/002 2/209
2006/0091784 A1 ‡ 5/2006 Conner ..... H01L 33/58 313/49
2006/0092621 A1 ‡ 5/2006 Lai ..... F01N 5/04 362/96
2006/0093264 A1 ‡ 5/2006 Tabuchi ..... G02B 6/3588 385/33
2006/0107952 A1 ‡ 5/2006 Schlosser ..... A41D 13/018 128/20
2006/0125624 A1 ‡ 6/2006 Ostrovsky ..... H05B 47/13 340/52
2006/0126323 A1 ‡ 6/2006 Pomes ..... A42B 1/244 362/10
2006/0138440 A1 ‡ 6/2006 Jyo ..... G09F 9/33 257/98
2006/0141828 A1 ‡ 6/2006 Dean ..... H01R 43/24 439/98
2006/0157569 A1 ‡ 7/2006 Becker ..... A42B 1/244 235/46

(56) References Cited

U.S. PATENT DOCUMENTS

2006/0158895 A1‡ 7/2006 Brands ..... F21V 5/006 362/55
2006/0165160 A1‡ 7/2006 Winningstad ..... H04M 1/05 375/21
2006/0198122 A1‡ 9/2006 Senter ..... A42B 3/044 362/10
2006/0212994 A1‡ 9/2006 Proctor ..... A42B 1/245 2/171
2006/0215393 A1‡ 9/2006 VanderSchuit ..... G09F 21/02 362/10
2006/0232955 A1‡ 10/2006 Labine ..... A42B 3/044 362/10
2006/0238995 A1‡ 10/2006 Wang ..... A61F 9/029 362/10
2006/0239018 A1‡ 10/2006 Jardin ..... B60Q 1/503 362/45
2006/0263677 A1‡ 11/2006 Tsai ..... H01M 2/1038 429/97
2006/0285315 A1‡ 12/2006 Tufenkjian ..... A61B 90/35 362/10
2006/0286443 A1‡ 12/2006 Huang ..... H01M 2/1038 429/10
2006/0291193 A1‡ 12/2006 Hill ..... B60Q 1/2673 362/10
2007/0003826 A1‡ 1/2007 Hsu ..... H01M 2/1044 429/97
2007/0013865 A1‡ 1/2007 Jordan ..... G02C 11/04 351/15
2007/0030442 A1‡ 2/2007 Howell ..... G02C 11/10 351/15
2007/0048598 A1‡ 3/2007 Huang ..... H01M 2/1038 429/97
2007/0053179 A1‡ 3/2007 Pang ..... A41D 27/085 362/10
2007/0058361 A1‡ 3/2007 Sevilla, II ..... F21V 33/0008 362/10
2007/0064413 A1‡ 3/2007 Slater ..... A42B 1/244 362/10
2007/0072655 A1‡ 3/2007 Cascone ..... H01Q 1/245 455/57
2007/0074752 A1‡ 4/2007 Shau ..... H02K 7/1892 136/20
2007/0086182 A1‡ 4/2007 Kelly ..... B68B 5/00 362/10
2007/0097668 A1‡ 5/2007 Choi ..... F21L 13/02 362/10
2007/0127250 A1‡ 6/2007 Waters ..... F21V 21/0885 362/41
2007/0140675 A1‡ 6/2007 Yanagi ..... G03B 17/04 396/88
2007/0145746 A1‡ 6/2007 Biamonte ..... F03G 5/06 290/1 R
2007/0153500 A1‡ 7/2007 Waters ..... F21V 21/0885 362/10
2007/0153537 A1‡ 7/2007 Scott ..... B60Q 1/2661 362/50
2007/0154029 A1‡ 7/2007 Werner ..... A61F 11/14 381/72
2007/0159810 A1‡ 7/2007 Kim ..... F21V 21/0885 362/10
2007/0159823 A1‡ 7/2007 Ho ..... F21L 13/06 362/25
2007/0171628 A1‡ 7/2007 Seade ..... A42B 1/245 362/10
2007/0189003 A1‡ 8/2007 Daley ..... A41G 7/02 362/10
2007/0206373 A1‡ 9/2007 Whiteside ..... A63B 71/143 362/10
2007/0236649 A1‡ 10/2007 Lin ..... G02C 5/02 351/41
2007/0236915 A1‡ 10/2007 Chen ..... A43B 1/0036 362/10
2007/0236916 A1‡ 10/2007 Hsu ..... A41B 9/002 362/10
2008/0049963 A1‡ 2/2008 Mann ..... H04R 5/0335 381/38
2008/0068559 A1‡ 3/2008 Howell ..... G02C 5/001 351/15
2008/0069391 A1‡ 3/2008 Steyn ..... H04R 1/1083 381/37
2008/0130272 A1‡ 6/2008 Waters ..... A42B 1/244 362/10
2008/0152482 A1‡ 6/2008 Patel ..... F24F 7/007 415/12
2008/0186705 A1‡ 8/2008 Liu ..... A42B 1/244 362/24
2008/0263750 A1‡ 10/2008 Chen ..... H04N 5/772 2/209
2008/0266839 A1‡ 10/2008 Claypool ..... A42B 1/244 362/10
2009/0010474 A1‡ 1/2009 Ouryouji ..... H04R 1/1083 381/37
2009/0126076 A1‡ 5/2009 Ochoa ..... A42B 1/008 2/171
2009/0147503 A1‡ 6/2009 Bennett ..... A47G 21/04 362/11
2009/0148149 A1‡ 6/2009 Chishima ..... H04N 5/2258 396/32
2009/0193566 A1‡ 8/2009 Waters ..... A42B 1/244 2/209
2009/0213323 A1‡ 8/2009 Hermanson ..... G02C 11/04 351/15
2009/0268936 A1‡ 10/2009 Goldberg ..... H04R 1/1041 381/38
2009/0323317 A1‡ 12/2009 Spartano ..... F21V 23/0414 362/10
2010/0024091 A1‡ 2/2010 Mehtab ..... A41D 15/005 2/69
2010/0095431 A1‡ 4/2010 Liao ..... A42B 1/244 2/209
2010/0134761 A1‡ 6/2010 Johns ..... A61B 5/163 351/20
2010/0182563 A1‡ 7/2010 Waters ..... F21V 21/084 351/15
2010/0207540 A1‡ 8/2010 Walton ..... F21V 19/008 315/291
2010/0214767 A1‡ 8/2010 Waters ..... F21V 21/0885 362/10
2010/0242155 A1‡ 9/2010 Carullo, Jr. ..... A61N 5/0617 2/171
2010/0289433 A1‡ 11/2010 Lau ..... A42B 1/244 315/313
2010/0307931 A1‡ 12/2010 Waters ..... A42B 1/244 206/8
2010/0313335 A1‡ 12/2010 Waters ..... H04N 13/207 2/209
2011/0013135 A1‡ 1/2011 Waters ..... G02C 11/04 351/15
2011/0075095 A1‡ 3/2011 Waters ..... G02C 11/04 351/15
2011/0122601 A1‡ 5/2011 Waters ..... A42B 1/244 362/10
2011/0187989 A1‡ 8/2011 Waters ..... F21L 4/00 351/15
2011/0210685 A1‡ 9/2011 Liao ..... H05B 47/10 315/31
2011/0211156 A1‡ 9/2011 Beiner ..... G02C 11/04 351/15
2011/0228211 A1‡ 9/2011 Waters ..... G02C 11/04 351/15
2011/0242799 A1‡ 10/2011 Dyer ..... A42B 1/244 362/105
2012/0014095 A2‡ 1/2012 Waters ..... F21L 4/027 362/10
2012/0098465 A1‡ 4/2012 Rothschild ..... F21V 23/0407 315/36
2013/0025612 A1‡ 1/2013 Hunter ..... A41G 3/00 132/53

(56) References Cited

U.S. PATENT DOCUMENTS

| | | | | |
|---|---|---|---|---|
| 2013/0033852 | A1‡ | 2/2013 | Liao | A42B 1/24 362/106 |
| 2013/0111651 | A1‡ | 5/2013 | Waters | A42B 1/242 2/209 |
| 2013/0192961 | A1‡ | 8/2013 | Waters | F21V 23/04 200/43 |
| 2013/0198935 | A1‡ | 8/2013 | Waters | A42C 5/00 2/209 |
| 2014/0049947 | A1‡ | 2/2014 | Lombard | A41D 19/0157 362/10 |
| 2014/0101827 | A1‡ | 4/2014 | Dennis | A42B 1/041 2/410 |
| 2014/0173807 | A1‡ | 6/2014 | Waters | A42B 1/244 2/209 |
| 2014/0237706 | A1‡ | 8/2014 | O'Conner | A42B 1/08 2/410 |
| 2014/0268683 | A1‡ | 9/2014 | Waters | A42B 1/244 362/10 |
| 2014/0268684 | A1‡ | 9/2014 | Waters | F21V 21/14 362/106 |
| 2014/0270685 | A1‡ | 9/2014 | Letke | H04N 5/2251 386/22 |
| 2015/0036324 | A1‡ | 2/2015 | Fitzgerald | A42B 1/242 362/106 |
| 2015/0063777 | A1‡ | 3/2015 | Letke | A42B 1/244 386/224 |
| 2015/0358515 | A1‡ | 12/2015 | Resnick | A45F 5/02 348/37 |
| 2016/0337745 | A1‡ | 11/2016 | Adams | H04R 1/1058 |
| 2019/0178477 | A1‡ | 6/2019 | Ross | F21V 21/084 |

FOREIGN PATENT DOCUMENTS

| | | | | |
|---|---|---|---|---|
| AU | 199940150 | | ‡ | 2/2000 |
| AU | 199959545 | | ‡ | 3/2000 |
| AU | 2002100976 | | ‡ | 6/2003 |
| AU | 2003100277 | | ‡ | 7/2003 |
| AU | 2003248016 | | ‡ | 11/2004 |
| CA | 2029772 | | ‡ | 5/1991 |
| CA | 2198625 | | ‡ | 2/1997 |
| CA | 2184336 | | ‡ | 5/1997 |
| CA | 2406450 | | ‡ | 11/2001 |
| CA | 2466175 | A1 | ‡ | 5/2003 |
| CA | 2608746 | A1 | ‡ | 11/2006 |
| CA | 2610073 | A1 | ‡ | 5/2008 |
| CN | 86208973 | | ‡ | 10/1987 |
| CN | 2173427 | | ‡ | 8/1994 |
| CN | 2239167 | | ‡ | 11/1996 |
| CN | 2423761 | | ‡ | 3/2001 |
| CN | 2433836 | | ‡ | 6/2001 |
| CN | 2458892 | | ‡ | 11/2001 |
| CN | 2508592 | | ‡ | 9/2002 |
| CN | 2544551 | | ‡ | 4/2003 |
| CN | 1462597 | | ‡ | 12/2003 |
| CN | 1603677 | A | ‡ | 4/2005 |
| CN | 101950091 | A | ‡ | 1/2011 |
| CN | 301445845 | S | | 1/2011 |
| CN | 201796205 | U | ‡ | 4/2011 |
| DE | 3043007 | | ‡ | 6/1982 |
| DE | 8230583 | | ‡ | 9/1983 |
| DE | 9410886 | | ‡ | 9/1994 |
| DE | 29808222 | | ‡ | 11/1998 |
| DE | 19837151 | | ‡ | 4/2000 |
| DE | 20007738 | | ‡ | 9/2000 |
| DE | 29915607 | | ‡ | 9/2000 |
| DE | 20017922 | | ‡ | 2/2001 |
| DE | 20020515 | | ‡ | 8/2001 |
| DE | 20101380 | | ‡ | 8/2001 |
| DE | 20106261 | | ‡ | 9/2001 |
| DE | 20111815 | | ‡ | 11/2001 |
| DE | 10046295 | | ‡ | 3/2002 |
| DE | 20117740 | | ‡ | 4/2002 |
| DE | 20201557 | | ‡ | 5/2002 |
| DE | 20200058 | | ‡ | 6/2002 |
| DE | 10103591 | | ‡ | 8/2002 |
| DE | 20110124 | | ‡ | 8/2002 |
| DE | 10057388 | | ‡ | 9/2002 |
| DE | 20209115 | | ‡ | 10/2002 |
| DE | 20210806 | | ‡ | 10/2002 |
| DE | 10216152 | | ‡ | 12/2002 |
| DE | 20209611 | | ‡ | 1/2003 |
| DE | 20313629 | | ‡ | 12/2003 |
| DE | 10330589 | | ‡ | 1/2004 |
| DE | 20319297 | | ‡ | 2/2004 |
| DE | 20318860 | | ‡ | 4/2004 |
| DE | 20318949 | | ‡ | 4/2004 |
| DE | 202004004960 | | ‡ | 9/2005 |
| DE | 102007006860 | A1 | ‡ | 8/2007 |
| DE | 301445845 | S | ‡ | 1/2011 |
| EP | 1072204 | | ‡ | 1/2001 |
| EP | 1374707 | | ‡ | 1/2004 |
| EP | 1451633 | | ‡ | 9/2004 |
| EP | 2290433 | A1 | ‡ | 3/2011 |
| EP | 2299311 | A1 | ‡ | 3/2011 |
| EP | 2350734 | A1 | ‡ | 8/2011 |
| FR | 1221782 | | ‡ | 6/1960 |
| FR | 2798721 | | ‡ | 3/2001 |
| FR | 2824709 | | ‡ | 11/2002 |
| FR | 2829365 | | ‡ | 3/2003 |
| FR | 2833068 | | ‡ | 6/2003 |
| FR | 2833069 | | ‡ | 6/2003 |
| GB | 2268043 | | ‡ | 1/1994 |
| GB | 2272073 | A | ‡ | 5/1994 |
| GB | 2316293 | | ‡ | 2/1998 |
| GB | 2358575 | | ‡ | 8/2001 |
| GB | 2363314 | | ‡ | 12/2001 |
| GB | 2374401 | | ‡ | 10/2002 |
| GB | 2378117 | | ‡ | 2/2003 |
| GB | 2378118 | | ‡ | 2/2003 |
| GB | 2388298 | | ‡ | 11/2003 |
| JP | S61006304 | | ‡ | 1/1986 |
| JP | 4289602 | | ‡ | 10/1992 |
| JP | H08027610 | A | ‡ | 1/1996 |
| JP | H08298004 | A | ‡ | 11/1996 |
| JP | H09209210 | A | ‡ | 8/1997 |
| JP | H09296319 | A | ‡ | 11/1997 |
| JP | H1039407 | | | 2/1998 |
| JP | H10081275 | A | ‡ | 3/1998 |
| JP | H10331019 | A | ‡ | 12/1998 |
| JP | 2001131818 | A | ‡ | 5/2001 |
| JP | 3084061 | | ‡ | 2/2002 |
| JP | 3090973 | | ‡ | 10/2002 |
| JP | 3090973 | | | 1/2003 |
| JP | 2004207580 | | ‡ | 7/2004 |
| JP | 2004346470 | | ‡ | 12/2004 |
| JP | 2005216832 | A | ‡ | 8/2005 |
| JP | 2006097156 | A | ‡ | 4/2006 |
| JP | 2007119980 | | ‡ | 5/2007 |
| JP | 2008542558 | | ‡ | 11/2008 |
| KR | 200164075 | | ‡ | 2/2000 |
| KR | 200168822 | Y1 | ‡ | 2/2000 |
| KR | 200168826 | | ‡ | 2/2000 |
| KR | 200260980 | | ‡ | 1/2002 |
| KR | 20020065405 | | ‡ | 8/2002 |
| KR | 200331201 | | ‡ | 10/2003 |
| TW | 241462 | | ‡ | 2/1995 |
| TW | 275188 | | ‡ | 5/1996 |
| TW | 286489 | | ‡ | 9/1996 |
| TW | 324234 | | ‡ | 1/1998 |
| TW | 329607 | | ‡ | 4/1998 |
| TW | 386364 | | ‡ | 4/2000 |
| WO | 9402043 | | ‡ | 2/1994 |
| WO | 9704434 | | ‡ | 2/1997 |
| WO | 0113033 | | | 2/2001 |
| WO | 01013033 | A1 | ‡ | 2/2001 |
| WO | 2001013033 | | ‡ | 2/2001 |
| WO | 0177575 | | | 10/2001 |
| WO | 01077575 | A1 | ‡ | 10/2001 |
| WO | 2001077575 | | ‡ | 10/2001 |
| WO | 0244611 | | ‡ | 6/2002 |
| WO | 02062165 | | ‡ | 8/2002 |
| WO | 02074398 | | ‡ | 9/2002 |

(56) References Cited

FOREIGN PATENT DOCUMENTS

| | | | | |
|---|---|---|---|---|
| WO | 02077520 | | ‡ | 10/2002 |
| WO | 2003040808 | A2 | ‡ | 5/2003 |
| WO | 03047377 | | ‡ | 6/2003 |
| WO | 03083811 | | ‡ | 10/2003 |
| WO | 2004000054 | | ‡ | 12/2003 |
| WO | 2004064555 | | ‡ | 5/2004 |
| WO | 2004103104 | | ‡ | 12/2004 |
| WO | 2005002378 | | ‡ | 1/2005 |
| WO | 2005005882 | | ‡ | 1/2005 |
| WO | 2005038337 | | ‡ | 4/2005 |
| WO | 2005096856 | | ‡ | 10/2005 |
| WO | 2005098314 | | ‡ | 10/2005 |
| WO | 2006037845 | | ‡ | 4/2006 |
| WO | 2006124928 | | ‡ | 11/2006 |
| WO | 2007073047 | | ‡ | 6/2007 |
| WO | 2007073219 | | ‡ | 6/2007 |
| WO | 2007089236 | | ‡ | 8/2007 |
| WO | 2007093348 | | ‡ | 8/2007 |
| WO | 2007112338 | | ‡ | 10/2007 |
| WO | 2008011750 | | ‡ | 1/2008 |
| WO | 2009079656 | A2 | ‡ | 6/2009 |
| WO | 2010099504 | | ‡ | 9/2010 |
| WO | 2011041591 | A1 | ‡ | 4/2011 |
| WO | 2011100471 | A1 | ‡ | 8/2011 |
| WO | 2011137400 | | ‡ | 11/2011 |
| WO | 2011137406 | | ‡ | 11/2011 |
| WO | 2013096895 | | ‡ | 6/2013 |
| WO | 2013096904 | | ‡ | 6/2013 |
| ZA | 20043826 | A | ‡ | 9/2005 |

OTHER PUBLICATIONS

'Panther Vision Power Beanie—Available at Bunnings Warehouse,' screenshot of a video posted to Youtube on Jun. 16, 2014. Retrieved from the Internet on Mar. 9, 2015. URL: https://www.youtube.com/watch?v=ZOWodRoEuvc. (1 page).

'Waters Industries' Answer To Defendant's Amended Counterclaims', *Waters Industries, Inc.* v. *Outdoor Cap Co., Inc.*, United States District Court for the Northern District of Illinois, Case No. 1:13-cv-07191, 12 pages (Document No. 38, Dec. 18, 2013).

"4 LED Lighted Fleece Beanie; POWERCAP," article posted on-line to WISE-SHOP.ca. Added to the businesses catalog on Nov. 6, 2013. Retrieved from the Internet on Jun. 17, 2014. URL: http://www.wise-shop.ca/product_info.php?products_id=489.

"Answer to Complaint, Counter claims",filed by Lilian Vernon Corporation, *Waters Industries, Inc.* v. *Sweet Baby, Inc. dba AJ Morgan et al.*, United States District Court for the Northern District of Illinois, Case No. 1:09-cv-07595, 15 pages (Docket No. 28, Feb. 4, 2010).

"Answer to Complaint, Counterclaims", filed by Sweet Baby, Inc. dba AJ Morgan, *Waters Industries, Inc.* v. *Sweet Baby, Inc. dba AJ Morgan et al.*, United States District Court for the Northern District of Illinois, Case No. 1:09-cv-07595, 15 pages (Docket No. 27, Feb. 4, 2010).

"Complaint" with Exhibit A through D, *Waters Industries, Inc.* v. *JJI International, Inc., et al.*, United States District Court for the Northern District of Illinois, Case No. 1:11-cv-03791, 73 pages (Document No. 1, Jun. 3, 2011).

"Complaint", *Waters Industries, Inc.* v. *Kikkerland Design, Inc.*, United States District Court for the Northern District of Illinois, Case No. 1:10-cv-04076, 21 pages (Docket No. 1, Jun. 30, 2010).

"Complaint", *Waters Industries, Inc.* v. *Mr. Christmas Incorporated, et al.*, United States District Court for the Northern District of Illinois, Case No. 1:09-cv-07577, 38 pages (Docket No. 1, Dec. 7, 2009).

"Complaint", *Waters Industries, Inc.* v. *Sweet Baby, Inc. dba AJ Morgan et al.*, United States District Court for the Northern District of Illinois, Case No. 1:09-cv-07595, 78 pages (Docket No. 1, Dec. 7, 2009).

"Complaint", *Waters Industries, Inc.* v. *The Gerson Company*, United States District Court for the Northern District of Illinois, Case No. 1:10-cv-01865,71 pages (Docket No. 1, Mar. 24, 2010).

"Defendants'Answer and Counterclaim" and "Responses to Specific Allegations", *Waters Industries, Inc.* v. *JJI International, Inc. and Stein Mart, Inc.*, United States District Court for the Northern District of Illinois, Case No. 1:11-cv-03791, 16 pages (Document No. 15, Jun. 28, 2011).

"Defendants' Initial Non-Infringement And Invalidity Contentions" with Appendix A though G, *Waters Industries, Inc.* v. *JJI International, Inc. and Stein Mart, Inc.*, United States District Court for the Northern District of Illinois, Case No. 1:11-cv-03791, 78 pages (Aug. 9, 2011).

"Kikkerland Design, Inc.'s Answer to Complaint, Affirmative Defenses and Counterclaim", *Waters Industries, Inc.* v. *Kikkerland Design, Inc.*,United States District Court for the Northern District of Illinois, Case No. 1:10-cv-04076, 12 pages (Docket No. 17, Aug. 6, 2010).

"Panther Vision Powercap LED Lighted Beanie," article posted on-line and available for sale at Dick's Sporting Goods with reviews posted as early as Nov. 14, 2014. Retrieved from the Internet on Mar. 9, 2015. URL: http://www.dickssportinggoods.com/product/index.jsp?productId=52376526. (4 pages).

"Plaintiff's Initial Infringement Contentions Under Local Patent Rule 2.2" with Appendix A through F,*Waters Industries, Inc.* v. *JJI International, Inc. and Stein Mart, Inc.*, United States District Court for the Northern District of Illinois, Case No. 1:11-cv-03791, 44 pages (Jul. 26, 2011).

"Plaintiffs Initial Response to Invalidity Contentions Under Local Patent Rule 2.5" with Appendix A and B, *Waters Industries, Inc.* v. *JJI International, Inc. and Stein Mart, Inc.*, United States District Court for the Northern District of Illinois, Case No. 1:11-cv-03791, 29 pages (Aug. 23, 2011).

"Powercap Beanie," article posted on-line to Panther Vision. Publication date unknown. Retrieved from the Internet on Mar. 9, 2015. URL: http://www.panther-vision-promotional-products.com/Prod-18-1-96-10/powercap-trade-beanie.htm. (2 pages).

"Answer and Counterclaim of Defendant Outdoor Cap Co., Inc.," *Waters Industries, Inc.* v. *Outdoor Cap Co., Inc.*, United States District Court for the Northern District of Illinois, Case No. 1:13-cv-07191, 11 pages (Document No. 13, Oct. 30, 2013).

"Complaint", *Waters Industries, Inc.* v. *Totes Isotoner Corporation, et al.*, United States District Court for the Northern District of Illinois, Case No. 1:10-cv-04487 (Docket No. 1, Jul. 19, 2010) (26 pages).

"Declaratory Judgment Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 52 pages (Document No. 2, Oct. 8, 2013).

"First Amended Answer and Counterclaim of Defendant Outdoor Cap Co., Inc." with Exhibit A through G, *Waters Industries, Inc.* v. *Outdoor Cap Co., Inc.*, United States District Court for the Northern District of Illinois, Case No. 1:13-cv-07191, 201 pages (Document No. 34, Dec. 11, 2013).

"Plaintiff's Complaint" with Exhibit A, *Waters Industries, Inc.* v. *Outdoor Cap Co., Inc.*, United States District Court for the Northern District of Illinois, Case No. 1:13-cv-07191, 7 pages (Document No. 1, Oct. 8, 2013).

"Plaintiff's First Amended Complaint" with Exhibit A and Exhibit B, *Waters Industries, Inc.* v. *Outdoor Cap Co., Inc.*, United States District Court for the Northern District of Illinois, Case No. 4:13-cv-00665-CVE-FHM, 51 pages (Document No. 11, Oct. 10, 2013).

"Plaintiff's Initial Infringement Contentions Under Local Patent Rule 2.2" with Appendix A, Figures 1-5, and Exhibits 1-3, *Waters Industries, Inc.* v. *Outdoor Cap Co., Inc.*, United States District Court for the Northern District of Illinois, Case No. 1:13-cv-07191, 58 pages (Nov. 27, 2013).

"Waters Industries' Answer to Defendant's Counterclaims," *Waters Industries, Inc.* v. *Outdoor Cap Co., Inc.*, United States District Court for the Northern District of Illinois, Case No. 1:13-cv-07191, 5 pages (Document No. 28, Nov. 20, 2013).

Docket report of *Waters Industries, Inc.* v. *Kikkerland Design, Inc.*, United States District Court for the Northern District of Illinois, Case No. 1:10-cv-04076, filed Jun. 30, 2010, 4 pages.

(56) References Cited

OTHER PUBLICATIONS

Docket report of *Waters Industries, Inc.* v. *Mr. Christmas Incorporated, et al.*, United States District Court for the Northern District of Illinois, Case No. 1:09-cv-07577, filed Dec. 7, 2009, 5 pages.
Docket report of *Waters Industries, Inc.* v. *Outdoor Cap Co., Inc.*, United States District Court for the Northern District of Oklahoma, Case No. 4:13-cv-00665-CVE-FHM, filed Oct. 8, 2013 (7 pages).
Docket report of *Waters Industries, Inc.* v. *Sweet Baby, Inc. dba AJ Morgan et al.*, United States District Court for the Northern District of Illinois, Case No. 1:09-cv-07595, filed Dec. 7, 2009, 7 pages.
Docket report of *Waters Industries, Inc.* v. *The Gerson Company*, United States District Court for the Northern District of Illinois, Case No. 1:10-cv-01865, filed Mar. 24, 2010, 3 pages.
Docket report of *Waters Industries, Inc.* v. *Totes Isotoner Corporation, et al.*, United States District Court for the Northern District of Illinois, Case No. 1:10-cv-04487 filed Jul. 19, 2010 (4 pages).
Extended European search report issued in the related European Application No. 08 86 2753.4 dated Dec. 7, 2012 (7 pages).
Extended European search report issued in the related European Application No. 10 18 1592.6 dated Jan. 31, 2011 (7 pages).
Extended European search report issued in the related European Application No. 10 18 1593.4 dated Feb. 1, 2011 (8 pages).
International Search Report from the International Bureau of WIPO issued in the related International Application No. PCT/US02/35665, dated Jun. 27, 2003, 1 page.
Notification Concerning Transmittal of International Preliminary Report on Patentability and the Written Opinion of the International Searching Authority from the International Bureau of WIPO for International Application No. PCT/US2013/076689, dated Jul. 2, 2015, 7 pages.
Notification of Transmittal of the International Search Report and the Written Opinion of the International Searching Authority, or the Declaration from the International Bureau of WIPO for International Application No. PCT/US2008/087542 dated May 4, 2009, 12 pages.
Notification of Transmittal of the International Search Report and the Written Opinion of the International Searching Authority, or the Declaration from the International Bureau of WIPO for International Application No. PCT/US2010/025689 dated May 4, 2010, 14 pages.
Notification of Transmittal of the International Search Report and the Written Opinion of the International Searching Authority, or the Declaration from the International Bureau of WIPO for International Application No. PCT/US2010/050978, dated Dec. 3, 2010, 16 pages.
Notification of Transmittal of the International Search Report and the Written Opinion of the International Searching Authority, or the Declaration from the International Bureau of WIPO for International Application No. PCT/US2011/024400, dated Apr. 29, 2011, 13 pages.
Notification of Transmittal of the International Search Report and the Written Opinion of the International Searching Authority, or the Declaration from the International Bureau of WIPO for International Application No. PCT/US2011/034686 dated Aug. 1, 2011, 16 pages.
Notification of Transmittal of the International Search Report and the Written Opinion of the International Searching Authority, or the Declaration from the International Bureau of WIPO for International Application No. PCT/US2011/051596, dated Jan. 18, 2012, 9 pages.
Notification of Transmittal of the International Search Report and the Written Opinion of the International Searching Authority, or the Declaration from the International Bureau of WIPO for International Application No. PCT/US2014/028613, dated Sep. 19, 2014, 13 pages.
Notification of Transmittal of the International Search Report and the Written Opinion of the International Searching Authority, or the Declaration from the International Bureau of WIPO for International Application No. PCT/US2014/028945 dated Jul. 31, 2014, 9 pages.
Notification of Transmittal of the International Search Report and the Written Opinion of the International Searching Authority, or the Declaration from the International Bureau of WIPO for related International Application No. PCT/US2011/034695 dated Oct. 28, 2011, 12 pages.
Office Action issued in related Canadian Application No. 2,466,175 dated Sep. 22, 2010 (3 pages).
Office Action issued in related European Application No. 02 778 755.5 dated Feb. 20, 2007 (7 pages).
Office Action issued in related Japanese Application No. 2010-539834 dated Mar. 19, 2013, with English translation (10 pages).
Patent Examination Report issued in related Australian Application No. 2008338320 dated Nov. 1, 2012 (5 pages).
Supplementary European search report issued in the related European Application No. 02 77 8755 dated Jan. 19, 2005 (2 pages).
Written Opinion of the International Searching Authority and International Search Report from the International Bureau of WIPO for International Application No. PCT/US2006/018968, dated Oct. 16, 2006, 12 pages.
Written Opinion of the International Searching Authority and International Search Report from the International Bureau of WIPO for International Application No. PCT/US2008/087542, dated May 4, 2009, 12 pages.
Non-Final Office Action dated Oct. 14, 2021, in U.S. Appl. No. 16/934,746 (9 pages).

‡ imported from a related application

LIGHTED HEADGEAR AND ACCESSORIES THEREFOR

CROSS-REFERENCE TO RELATED APPLICATION

This application is a continuation of U.S. application Ser. No. 16/414,624, filed May 16, 2019, which is hereby incorporated by reference herein in its entirety.

FIELD OF THE INVENTION

This disclosure relates to lighting devices and, in particular, to lighted headgear and accessories therefor.

BACKGROUND

Often an individual desires a light source focused to illuminate an area while performing a task, or a light source directed in a general outward direction for visibility. Holding a flashlight is an option, but such lighting devices are often cumbersome and may detract from the task being completed because the flashlight must be held. As a result, hands-free lighting is often desired because the individual desiring illumination does not need to hold the light source. Common types of hands-free lighting include light sources mounted to headgear or eyeglasses.

Lighted headgear may include illumination sources mounted to hats. Often the light source is oriented outwardly in such a manner so that the wearer can be seen by others or oriented downward to provide light forwardly of the wearer so as to illuminate an area in the wearer's field of view. Often, the light source is one or more LEDs. Such LED lighted headgear, which may include LEDs mounted to a typical baseball-style hap or beanie-style cap, are convenient for hands-free lighting in a number of recreational activities, such as camping, hunting, fishing, jogging, or the like.

DETAILED DESCRIPTION

Figure 1:
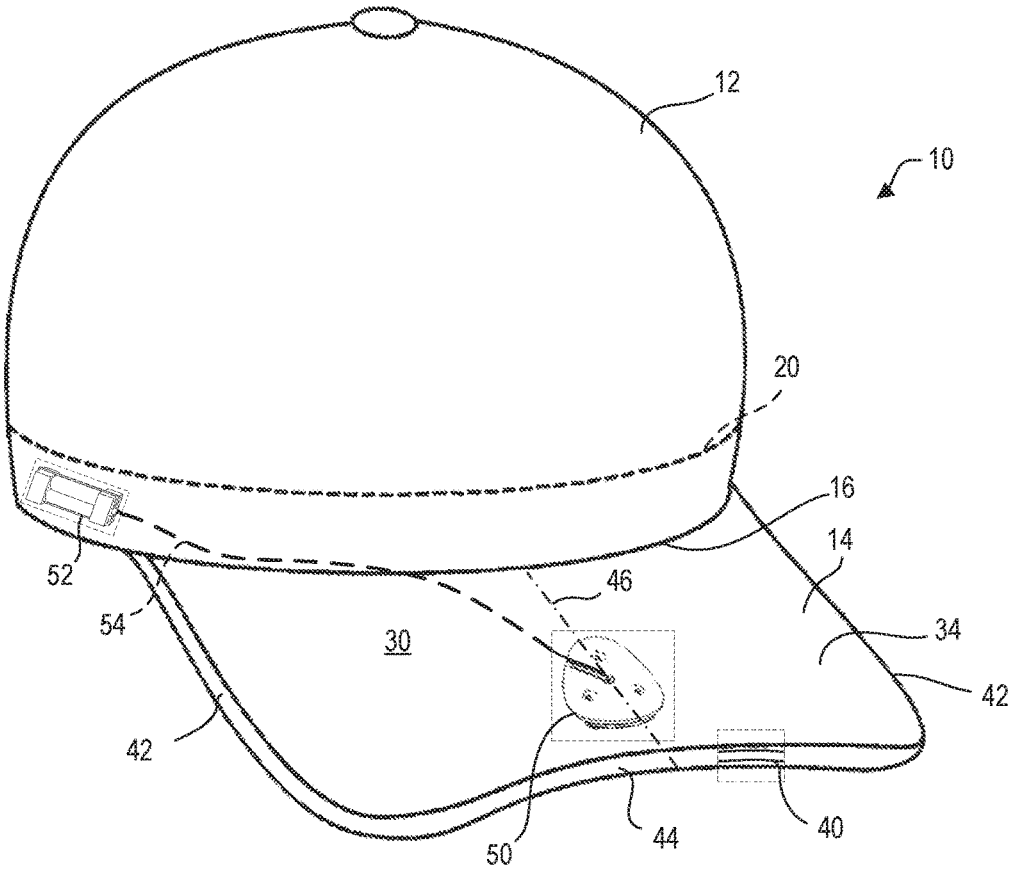
FIG. 1 is an upper perspective view of a baseball-style lighted hat having a battery pack and a light module to provide illumination generally forwardly and downwardly.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the present invention. As those of ordinary skill in the art will understand, various features illustrated and described with reference to any one of the figures is combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

In general, the headgear described herein include one or more illumination sources, which may include, for example, one or more light-emitting diodes (LEDs). One or more power assemblies are provided to energize these illumination sources. The power generators may use traditional batteries or renewable energy, such as solar, wind, or kinetic energy, to generate electrical power that ultimately energizes the light sources that is included on the disclosed headgear. While the following description and illustrations may describe a specific power assembly and illumination source with a specific headgear and lighting configuration, the various components described herein may be included in any of the headgear embodiments. The headgear may include, for example, a baseball-style hat, a beanie-style cap, or other suitable headgear such as visors, helmets, caps, hats, headbands, sweatband, hoods, clothing, or the like. The light modules described herein may also be mounted to other articles of clothing.

The lighted headgear described herein include a head fitting portion for fitting on a head of a user. A light module is mounted to the headgear for projecting light in the generally forward direction. The light modules discussed herein are generally low-profile light modules having ergonomically-actuated actuators. More particularly, the actuators are generally angled such that the actuating member (which may be, for example, a push-button) travels along an axis corresponding to a user's natural push direction. In the baseball-style cap example of FIGS. 1-9, the push direction is generally upward and forward relative to the user's forehead. In the beanie-style example of FIGS. 10-17, the push direction is generally downward and rearward relative to the user's forehead.

The light modules contemplated herein may include a reflector that has reflector walls for directing the light. More particularly, the reflective walls may focus the light in a generally forward direction, and optionally, in a generally downward direction. Focusing light in a generally downward direction may be particularly advantageous in light module secured to the brim of a baseball-style hat. For example, by directing light away from a downward surface of a brim portion of the hat, the reflector may reduce or inhibit glare off the brim portion.

Figure 2:
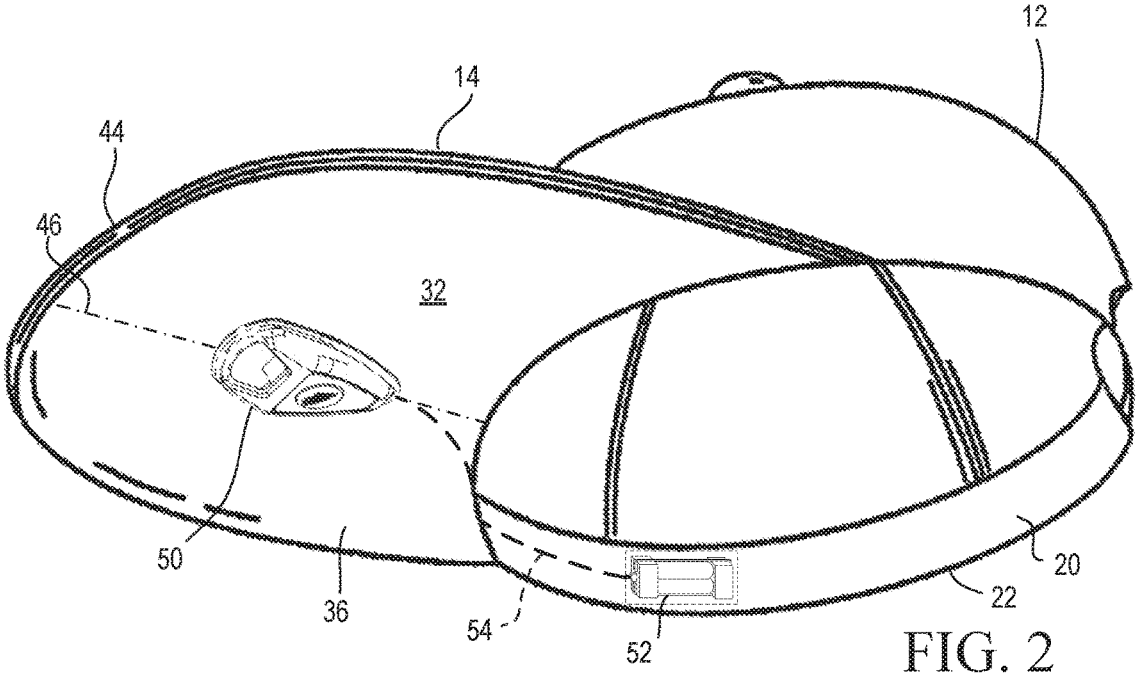
FIG. 2 is a lower perspective view of the baseball-style lighted hat of FIG. 1 showing the light module secured to the underside of a brim of the baseball-style lighted hat.

Referring to FIGS. 1 and 2, lighted headgear such as a lighted hat 10 is shown. The lighted hat 10 is be in the form of a baseball-style cap having a head fitting portion, such as crown portion 12, for fitting on a head of a user. The lighted hat 10 also includes a brim portion 14 that extends in a generally forward direction from the head fitting portion. For example, the brim portion 14 projects forwardly from a lower, forward edge 16 of the crown portion 12. In some forms, the lighted hat 10 further includes a hat band 20 disposed around a lower edge portion 22 of the inside of the lighted hat 10. The hat band 20 may be composed of an elastic and/or wicking material to conform the crown portion 12 more closely to a wearer's head and/or wick moisture away from the wearer's head.

The brim portion 14 has an upper major surface 30 and a lower major surface 32. As used herein, the upper major surface 30 faces generally upwardly when the lighted hat 10 is worn by a user, and the lower major surface 32 faces generally downwardly when the lighted hat 10 is worn by a user. The upper major surface 30 is disposed on an upper covering 34, and the lower major surface 32 is disposed on a lower covering 36. The upper and lower coverings 34, 36 is fabric coverings or other suitable material.

The brim portion 14 further includes a brim insert 40 that extends between the upper covering 34 and the lower covering 36. The brim portion 14 includes perimeter edges, such as side edges 42 and a front edge 44 that extends between the side edges 42. The brim portion 14, and more particularly, the lower major surface 32, has a generally fore-and-aft central axis 46 that extends in a forward direction between the side edges 42 and toward the front edge 44. The upper and lower coverings 34, 36 and the brim insert 40 may be joined together, such as by stitching, adhesive, or the like.

The lighted hat 10 includes a light module 50. The light module 50, discussed in greater detail with respect to FIGS. 3-9, is preferably disposed on the lower major surface 32 of the brim portion 14 (e.g., at the generally downwardly-facing surface of the brim portion 14).

Figure 18:
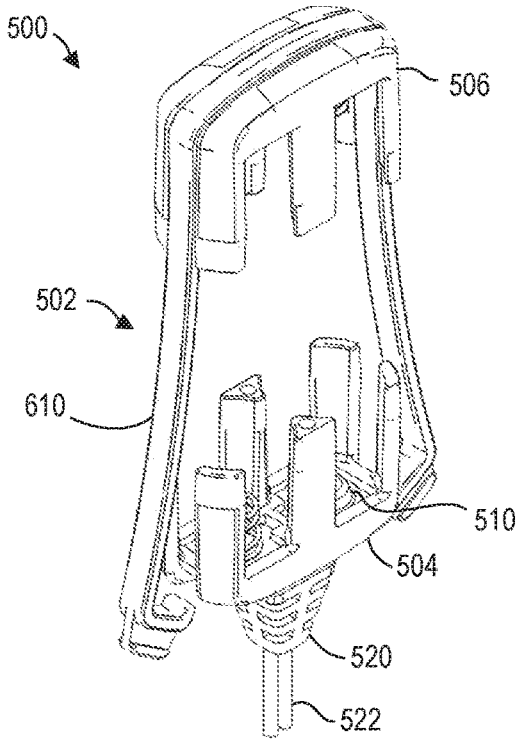
FIG. 18 is an upper perspective view of a battery holder in an unassembled configuration.
Figure 19:
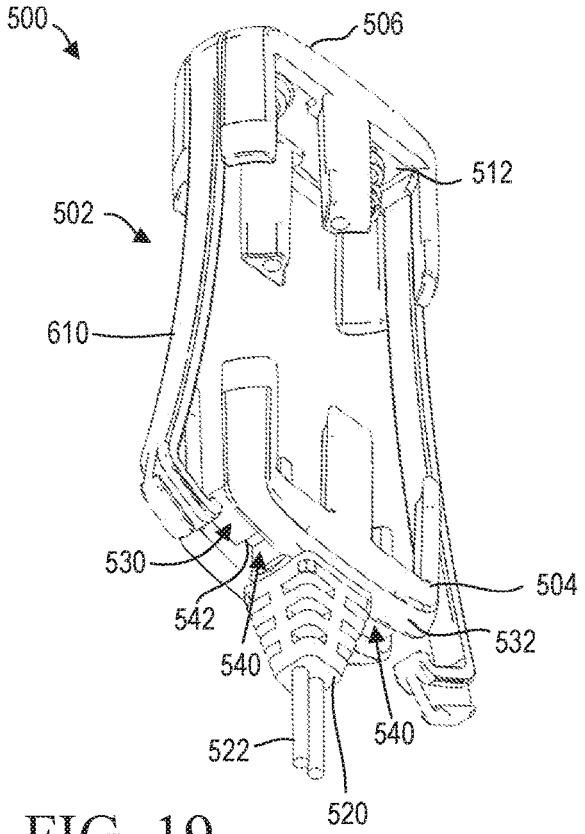
FIG. 19 is a lower perspective view of the battery holder of FIG. 18 in an unassembled configuration.
Figure 20:
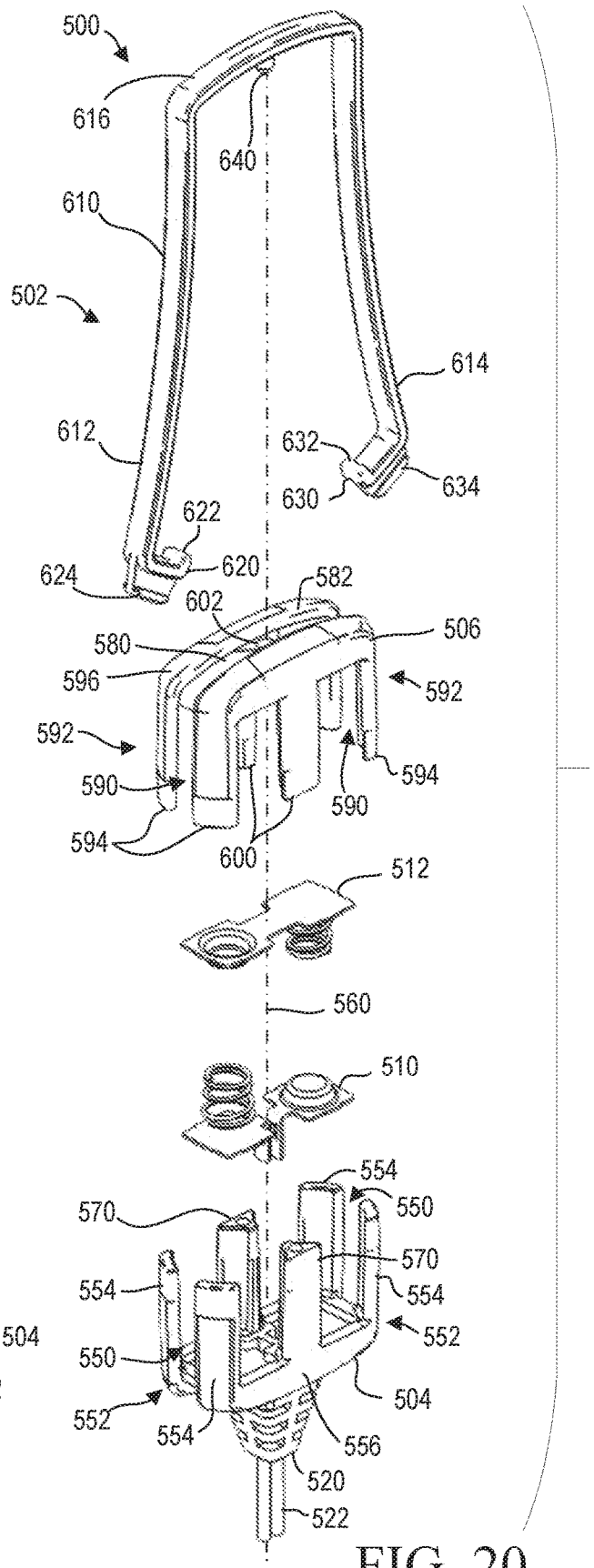
FIG. 20 is a perspective exploded view of the battery holder of FIG. 18 in an unassembled configuration.

The lighted hat 10 further includes a power source 52, and an electrical connection 54 that spans between the power source 52 and the light module 50. The electrical connection 54 may include one or more wires to provide power to the light module 50. The power source 52, discussed in greater detail with respect to FIGS. 18-20, is illustrated as a battery pack that is stored in the hat band 20 of the crown portion 12 of the lighted hat 10.

Figure 3:
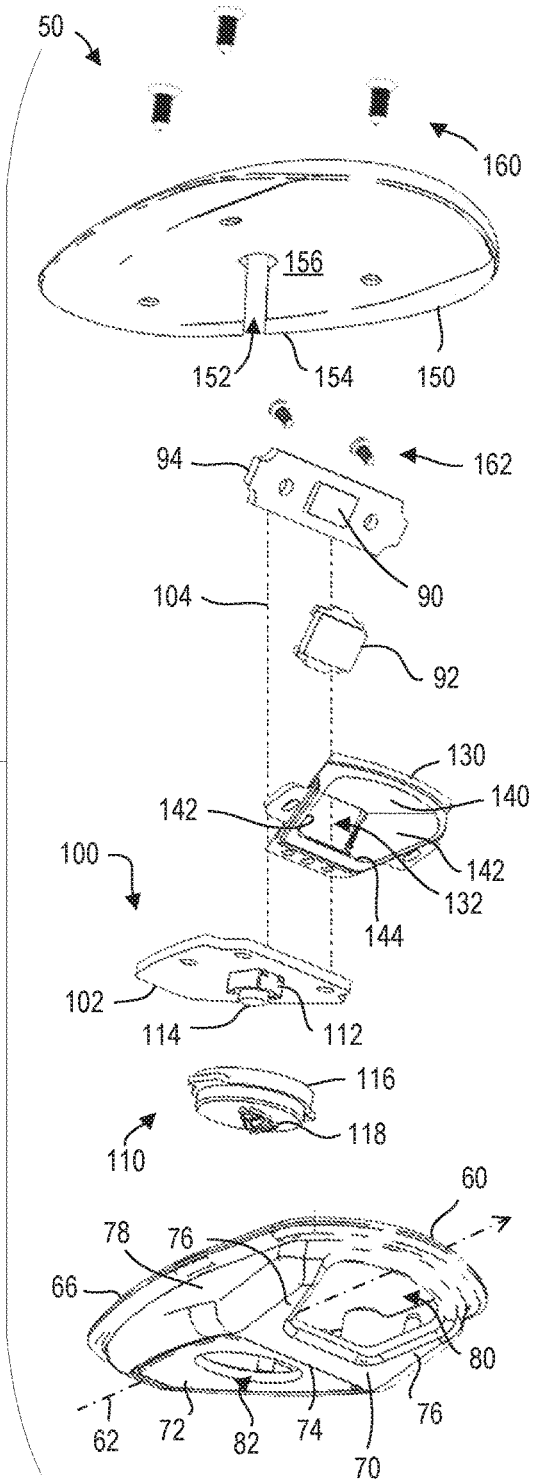
FIG. 3 is a lower perspective exploded view of the light module of FIG. 1 showing lower portions of various components of the light module.
Figure 4:
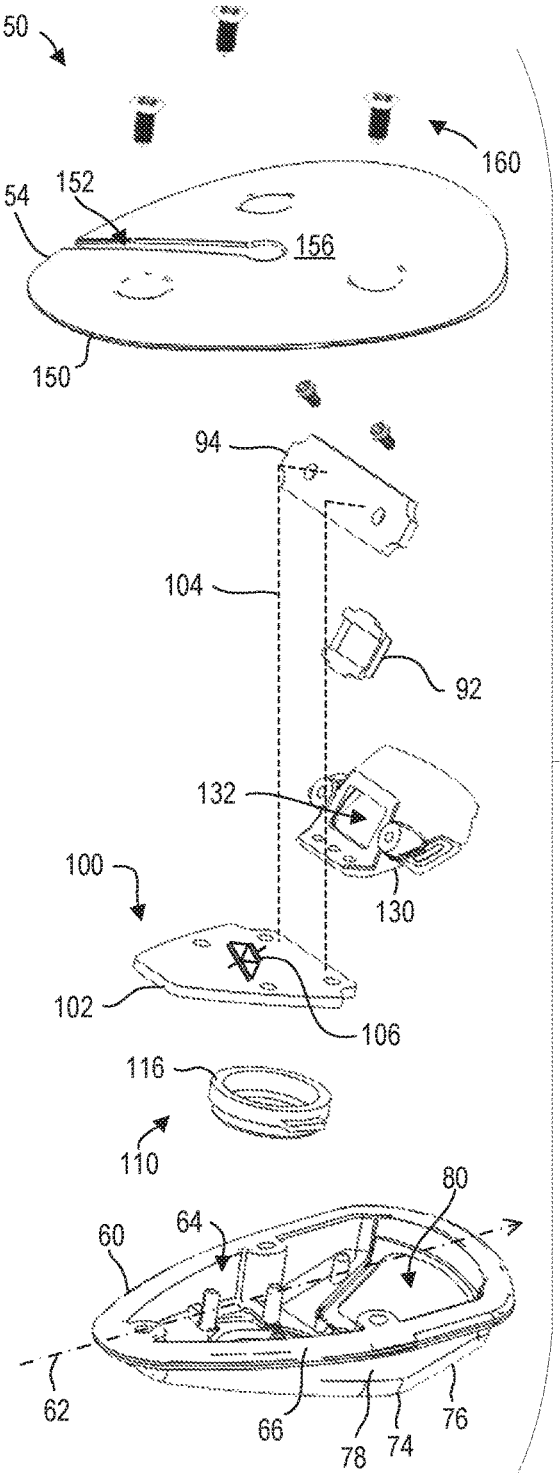
FIG. 4 is an upper perspective exploded view of the light module of FIG. 1 showing upper portions of various components of the light module.
Figure 5:
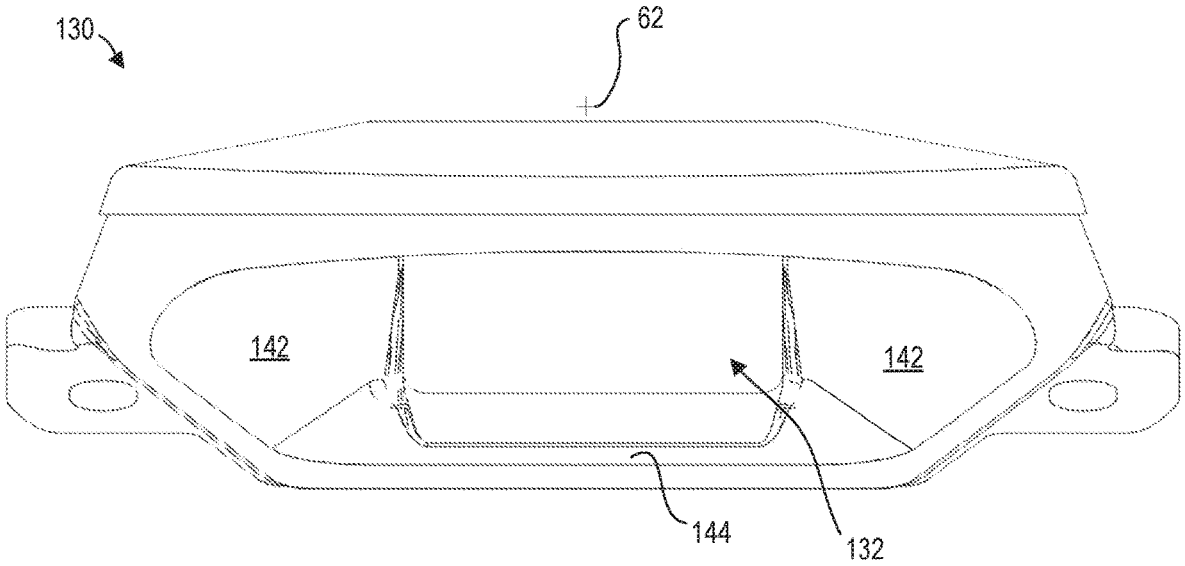
FIG. 5 is a front elevation view of a reflector of the light module of FIG. 1 showing reflector walls extending from a rearward opening of the reflector.
Figure 6:
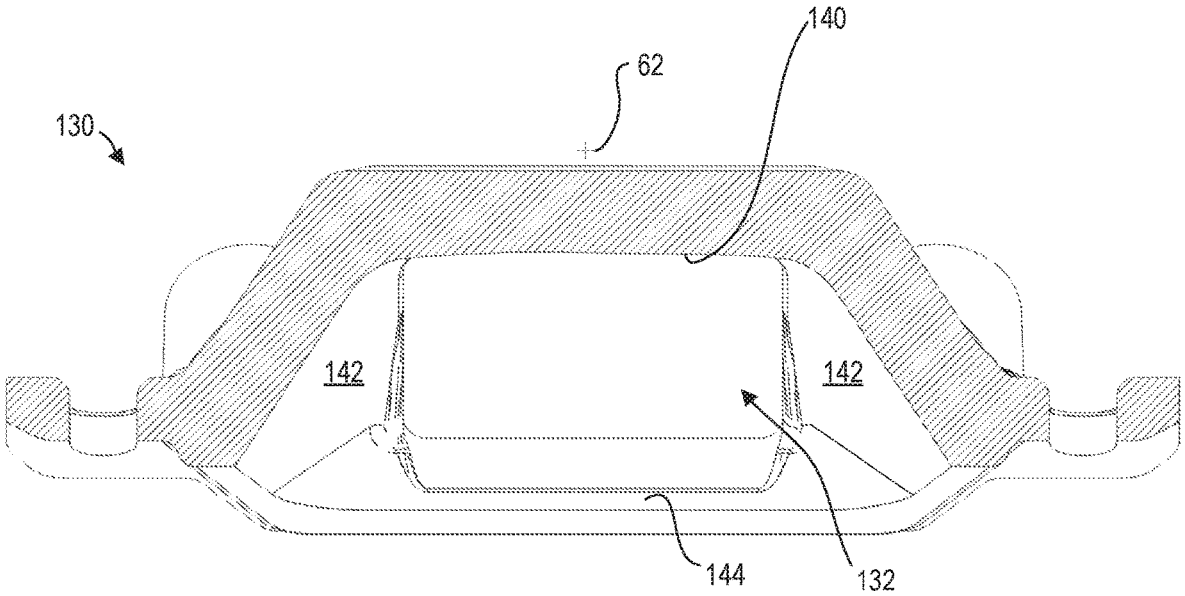
FIG. 6 is a cross-sectional view of the reflector of FIG. 5 showing the inclination of the opposing reflective side walls relative to the reflective upper wall.

Referring to FIGS. 3 and 4, the light module 50 includes a housing 60. The housing 60 has a central axis 62 that extends in a generally forward direction. The central axis 62 extends, for example, through or along a base flange 66 of the housing 60.

The housing 60 includes housing walls that extend from the base flange 66, and extend about a housing interior 64. As shown, the housing walls generally define a wedge-shaped housing. In this regard, the housing walls include a forward wall portion 70, a rearward inclined wall portion 72, and opposing side walls 78 that extend between the base flange 66 and the forward wall portion 70 and rearward inclined wall portion 72. In one approach, a side wall 78 forms a rearward curved or rounded side interface with the rearward inclined wall portion 72, and forms a forward curved or rounded side interface with the forward wall portion 70.

The forward wall portion 70 and the rearward inclined wall portion 72 converge to form an apex 74 of the housing 60. In one aspect, the apex 74 is a curved or rounded apex.

The forward wall portion 70 includes one or more opposite sections, referred to herein as side wall portions 76, that at least partially define an opening. For example, two opposing side wall portions 76 cooperate to at least partially form a forward opening 80, also referred to herein as a large light opening, therebetween.

In the approach shown, the side wall portions 76 taper as the side wall portions 76 extend in the forward direction along the central axis 62. For example, the lateral width (e.g., in a direction orthogonal to the central axis 62) of a side wall portion 76 varies from a maximum width closest to a apex 74, to a minimum width farthest from the apex 74. A side wall portion 76 may taper, for example, from a maximum lateral width of approximately 0.25 inches to a minimum lateral width of approximately 0.15 inches.

In this way, the opposing side wall portions 76 define a forward opening 80 that has a lateral width that varies as the forward opening 80 extends in the forward direction along the central axis 62. For example, the lateral width of the forward opening 80 varies from a minimum width closest to a apex 74, to a maximum width farthest from the apex 74. The forward opening 80 may taper, for example, may taper, for example, from a minimum lateral width of approximately 0.4 inches to a maximum lateral width of approximately 0.65 inches.

In one aspect, the forward opening 80 has a lateral width that is larger than a lateral width of at least one of the side wall portions 76. In one example approach, the minimum lateral width of the forward opening 80 is approximately equal to a combined lateral width of the maximum lateral widths of the opposite side wall portions 76, and the maximum lateral width of the forward opening 80 is larger than a combined lateral width of the maximum lateral widths of the opposite side wall portions 76.

The rearward inclined wall portion 72 has a generally planar wall portion that includes an actuator hole 82. As discussed in greater detail elsewhere herein, the actuator hole 82 is sized to receive a user-actuatable actuator, such as a push-button.

The light module 50 further includes a light source 90 mounted at least partially within the housing interior 64. The light source 90 provides illumination outwardly from the housing 60; for example, through the forward opening 80. In one aspect, the light source 90 includes a single LED. In another aspect, the light source 90 includes a plurality of LEDs. A cover or lens 92 may extend across the LED portion of the light source 90.

The light module 50 also includes a switch device 100. The switch device 100 is electrically coupled to the light source 90 and the power source 52 for selectively energizing the light source 90. The switch device 100 includes, for example, a circuit board 102 and an actuator 110. The circuit board 102, which may be a printed circuit board (PCB) that includes electrical circuitry 106, is electrically coupled to the light source 90, as indicated at coupling 104.

The actuator 110 includes a plunger housing 112 that is secured to the circuit board 102. The actuator 110 further includes a plunger 114 that is movable within the plunger housing 112. The actuator 110 further includes a resilient button 116 that extends over the plunger 114. The resilient button 116 may have tactile indicia 118, such as one or both of a depression and a protrusion. In this way, the tactile indicia 118 may provide a user with tactile feedback indicating the user's finger has engaged the resilient button 116.

The light module 50 further includes a heat sink member 94. The heat sink member 94 is formed of, or includes, conductive material. More particularly, the heat sink member 94 is formed of a material with high thermal conductivity, such as an aluminum alloy. As such, the heat sink member 94 may have a thermal conductivity value of between about 120 W/mK to about 240 W/mK to conduct heat away from the light source 90 during operation of the light module 50. The heat conduction by the heat sink member 94 reduces the risk of damaging components of the light module 50 through overheating. In the illustrated and preferred form, the heat sink member 94 has a generally rectangular body. Although depicted as having a single heat sink member 94, the light module 50 may be provided with two or more heat sink members.

In the assembled configuration, the heat sink member 94 is electrically coupled to the circuit board 102, and the light source 90 is secured to a heat sink member 94. More particularly, the heat sink member 94 is disposed between the light source 90 and the circuit board 102 such that the light source 90 is separated from the circuit board 102 by the heat sink member 94. As shown, the heat sink member 94 may be installed in an inclined orientation. The inclination of the heat sink member 94 generally corresponds to that of the forward wall portion 70. In this way, the heat sink member 94 extends generally parallel to the forward wall portion 70.

The light module 50 further includes a reflector 130. The reflector 130 is a discrete reflector that is mounted (e.g., removably mounted) to the housing 60 within the housing interior 64. More particularly, the reflector 130 is mounted at the forward opening 80 of the housing 60.

The reflector 130 includes a rearward opening 132 that is aligned with the light source 90 to permit light emitted from the light source 90 to pass therethrough. The reflector 130 further includes a plurality of reflective walls that may extend generally forwardly and outwardly from the rearward opening 132 to the forward opening 80 (e.g., into engagement with the housing 60). As used herein, a generally forward direction may refer to the forward direction along axis 62, and a generally outward direction may refer to a direction generally away from a central axis of light source 90. As such, the light source 90 may emit light in a direction that is generally forward and generally downward from the light module 50.

Referring to FIGS. 3-6, the plurality of reflective walls includes, for example, a reflective upper wall 140. The reflective upper wall 140 may extend generally forwardly from the rearward opening 132. As such, light emitted through the forward opening 80 is reflected generally downwardly (e.g., away from the generally downwardly-facing surface of the brim portion 14 of FIGS. 1 and 2).

The plurality of reflective walls further includes one or more reflective side walls. For example, the reflector 130 includes a pair of opposing reflective side walls 142. The reflective upper wall 140 may extend between the opposing reflective side walls 142. The opposing reflective side walls 142 may taper away from each other as the opposing reflective side walls 142 extend away (e.g., generally downwardly) from the reflective upper wall 140. In one aspect, the reflective upper wall 140 extends away from the rearward opening 132 further than at least one, and preferably both, of the opposing reflective side walls 142. Furthermore, the opposing reflective side walls 142 may taper away from each other as the opposing reflective side walls 142 extend away (e.g., generally forwardly) from the rearward opening 132.

The plurality of reflective walls further includes a reflective lower wall 144. The reflective lower wall 144 may extend generally forwardly from the rearward opening 132. In one aspect, the opposing reflective side walls 142 extend away from the rearward opening further than the reflective lower wall 144. The reflective upper wall 140 may extend forwardly from the rearward opening 132 further than the opposing reflective side walls 142, the reflective lower wall 144, or both the reflective lower wall 144 and each opposing reflective side walls 142.

Referring again to FIGS. 3 and 4, the light module 50 further includes a backplate or mounting plate 150. The mounting plate 150 is securable to the housing 60, or vice versa. The mounting plate 150 may include a guide slot 152 that extends through the mounting plate 150; for example, through an entire thickness of the mounting plate 150. The guide slot 152 may extend from an outer periphery 154 (e.g., an outer peripheral edge) of the mounting plate 150 to a central region 156 of the mounting plate 150. The guide slot 152 is sized to receive an electrical connection therein (e.g., electrical connection 54 of FIGS. 1 and 2). As such, the electrical connection 54 may extend from the power source 52, through the guide slot 152 of the mounting plate 150, into the housing interior 64, and to the switch device 100.

One or more fasteners 160 are provided for securing housing 60 to the mounting plate 150. Similarly, one or more fasteners 162 are provided for securing the heat sink member 94 to the reflector 130. The fasteners 160 may be, for example, threaded fasteners, rivets, or the like.

Figure 7:
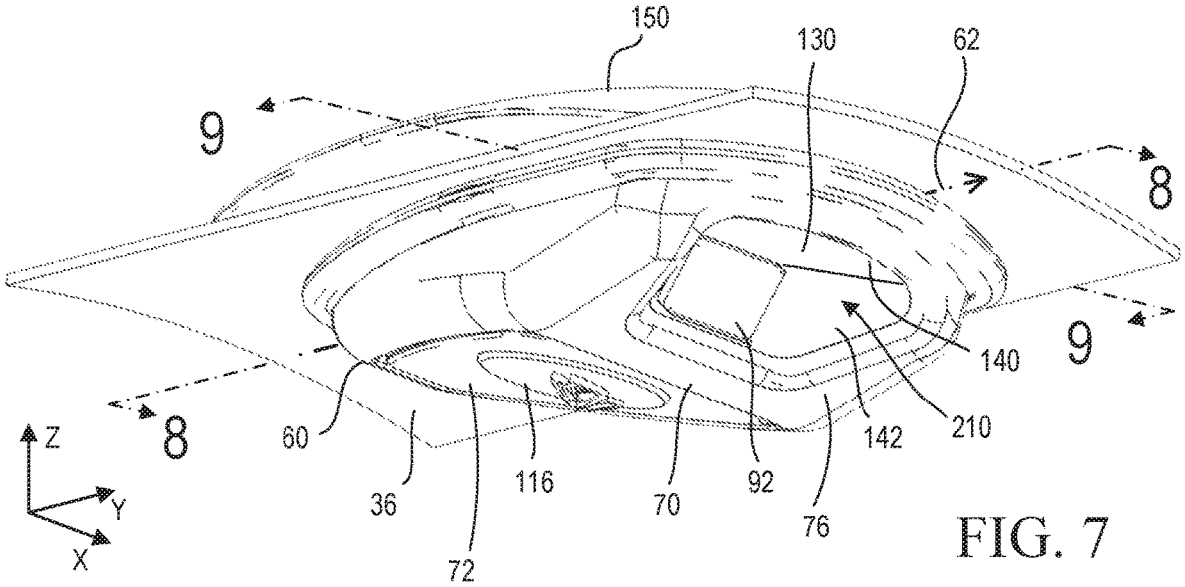
FIG. 7 is an enlarged perspective view of the light module of FIG. 1 showing a portion of the brim of the baseball-style lighted hat extending between the housing and the mounting plate of the light module.
Figure 8:
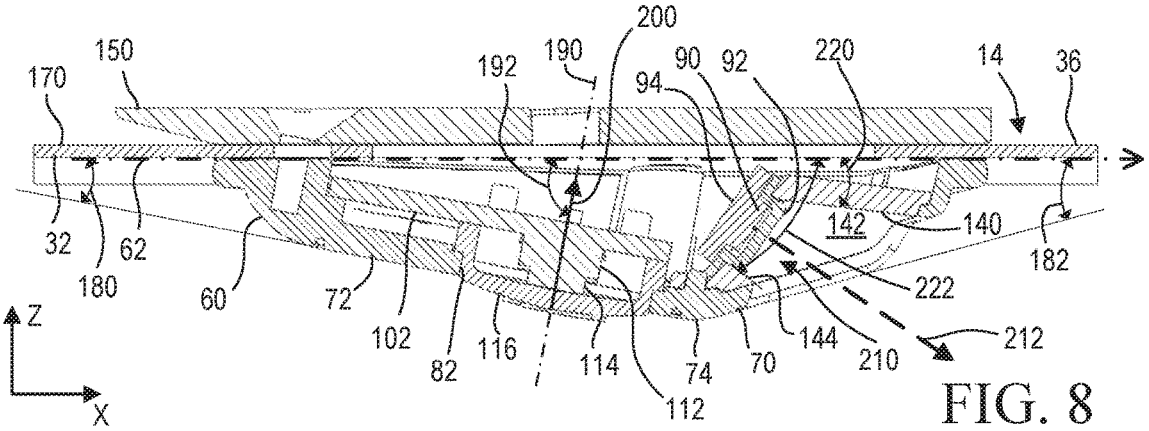
FIG. 8 is a cross-sectional view taken along the line 8-8 of FIG. 7 showing inclinations of various components of the light module.
Figure 9:
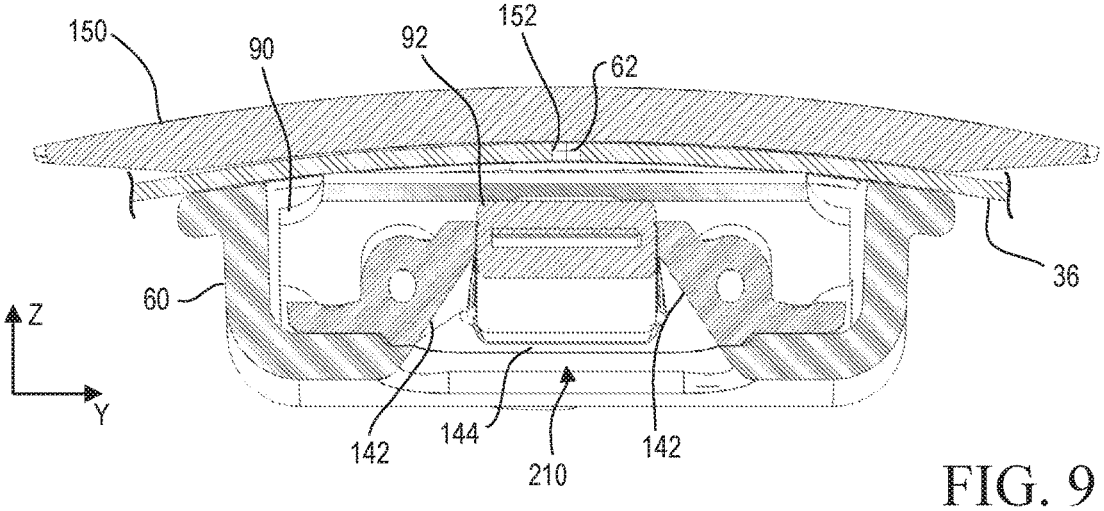
FIG. 9 is a cross-sectional view taken along the line 9-9 of FIG. 7 showing inclinations of various components of the light module.

Referring to FIGS. 7-9, in an assembled configuration, the mounting plate 150 is disposed at a brim-facing surface 170 of the lower covering 36, and the housing 60 is disposed at the lower major surface 32 of the lower covering 36 of the brim portion 14.

One or both of the rearward inclined wall portion 72 and the forward wall portion 70 may be inclined relative to the central axis 62. In one aspect, the rearward inclined wall portion 72 may extend at an oblique angle 180 relative to the central axis 62. The oblique angle 180 may be, for example, an acute angle in the range of approximately (e.g., +/−3 degrees) 5 degrees to approximately 40 degrees, and more particularly, is approximately 10 degrees. The forward wall portion 70 may also or may instead extend at an oblique angle 182 relative to the central axis 62.

The actuator 110 of the switch device 100 is associated with the rearward inclined wall portion 72. More particularly, the resilient button 116 of the actuator 110 is received in the actuator hole 82 of the rearward inclined wall portion 72. The actuator hole 82 includes a central hole axis 190 that intersects the central axis 62 at an oblique angle 192.

The actuator 110 is configured to travel in a linear actuation direction 200 when pushed by the user. During actuation, the resilient button 116 is deformed by the user to depress the plunger 114 in the linear actuation direction 200, which is arranged to be upwardly and forwardly relative to the generally downwardly-facing surface (e.g., lower major surface 32) of the brim portion 14 for ease of operation by the user.

In the depicted assembled configuration, the linear actuation direction 200 is orthogonal to the inclined circuit board 102. In one aspect, inclined circuit board 102 is mounted relative to the housing 60 (e.g., at least partially within the housing interior 64) such that the inclined circuit board 102 extends obliquely relative to the central axis 62.

The reflector 130 cooperates with the housing 60 to at least partially form a recessed light opening 210 of the light module 50. In the arrangement shown, the reflective upper wall 140 tapers downwardly away from the brim portion 14 as the reflective upper wall 140 extends generally forwardly from the rearward opening 132. The reflective lower wall 144 tapers downwardly away from the reflective upper wall 140 as the reflective lower wall 144 extends generally forwardly from the rearward opening 132.

In one approach, the reflective upper wall 140 tapers downwardly away from the brim portion 14 at a first oblique angle 220 as the reflective upper wall 140 extends generally forwardly from the rearward opening 132. The reflective lower wall tapers 144 downwardly away from the brim portion 14 at a second oblique angle 222 as the reflective lower wall 144 extends generally forwardly from the rearward opening 132. The second oblique angle 222 is different (e.g., greater) than the first oblique angle 220.

As such, the light source 90 is oriented to emit light in a direction 212 that is generally forwardly transverse to the linear actuation direction 200. The reflector 130 may act to prevent or inhibit light emitted from the light source 90 from casting on (and reflecting off of) the lower major surface 32 of the brim portion 14 (e.g., at the generally downwardly-facing surface of the brim portion 14). In this way, a field of view of a user that is generally forward and generally downward from the lighted hat 10 is illuminated, while glare in the user's line of sight is reduced or inhibited.

Figure 10:
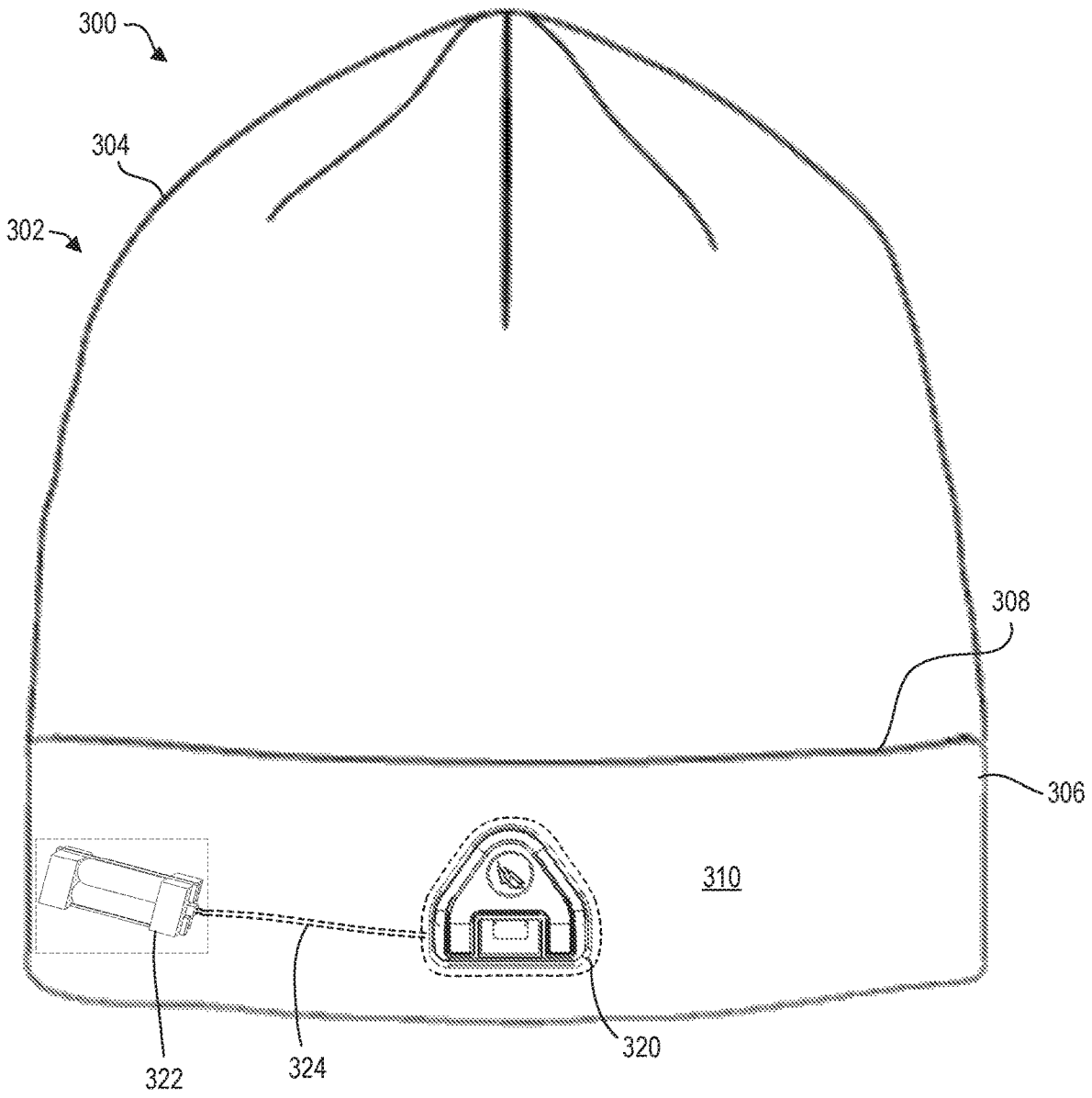
FIG. 10 is a front elevation view a beanie-style lighted cap having a battery pack and a light module to provide illumination generally forwardly.

Referring to FIG. 10, lighted headgear such as a lighted cap 300 is shown. The lighted cap 300 is in the form of a knit cap, which may be referred to as a beanie. The lighted cap 300 has a head fitting portion 302 for fitting on a head of a user. The head fitting portion 302 includes a crown portion 304, which may be referred to as a tapering portion, and an annular portion 306 that extends below the crown portion 304 when worn on a head of a user. The lighted cap 300 includes a cap band 308 disposed at a lower region of the annular portion 306 (e.g., inside of the lighted cap 300). The lighted cap 300, and more particularly, the cap band 308, includes a forwardly-facing surface 310 when worn.

The lighted cap 300 further includes a light module 320. The light module 320, discussed in greater detail with respect to FIGS. 11-17, is disposed at the cap band 308, and more particularly, at the forwardly-facing surface 310.

The lighted cap 300 further includes a power source 322, and an electrical connection 324 that spans between the power source 322 and the light module 320. The electrical connection 324 may include one or more wires to provide power to the light module 320. The power source 322, discussed in greater detail with respect to FIGS. 18-20, is illustrated as a battery pack that is stored in the cap band 308 of the annular portion 306 of the lighted cap 300.

Figure 11:
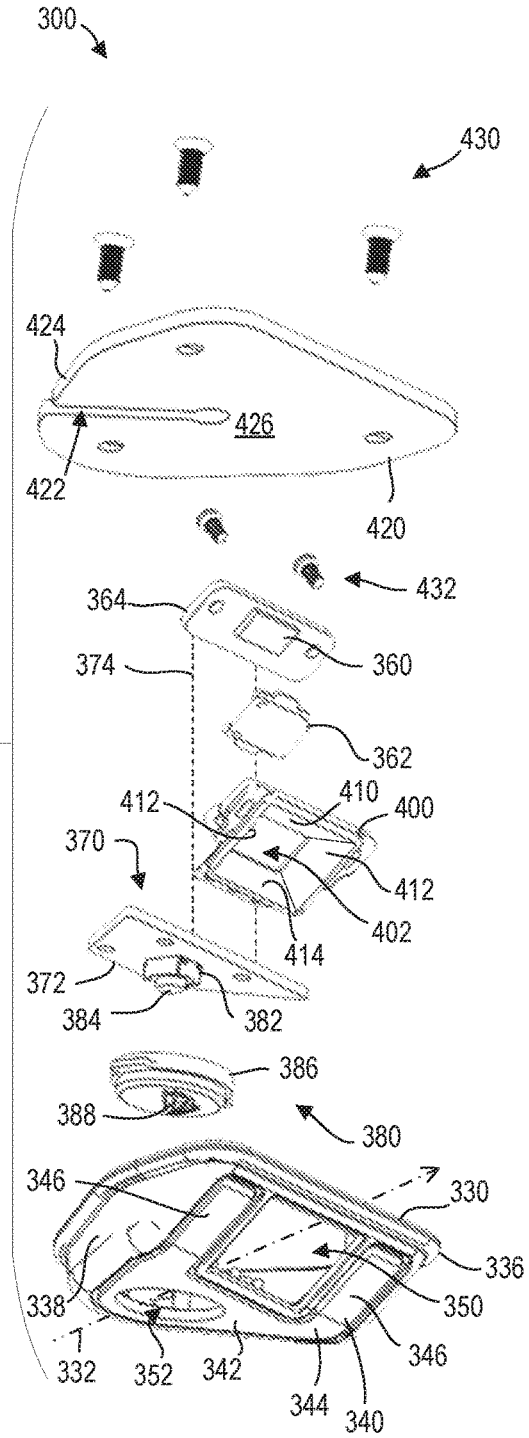
FIG. 11 is a lower perspective exploded view of the light module of FIG. 10 showing lower portions of various components of the light module.
Figure 12:
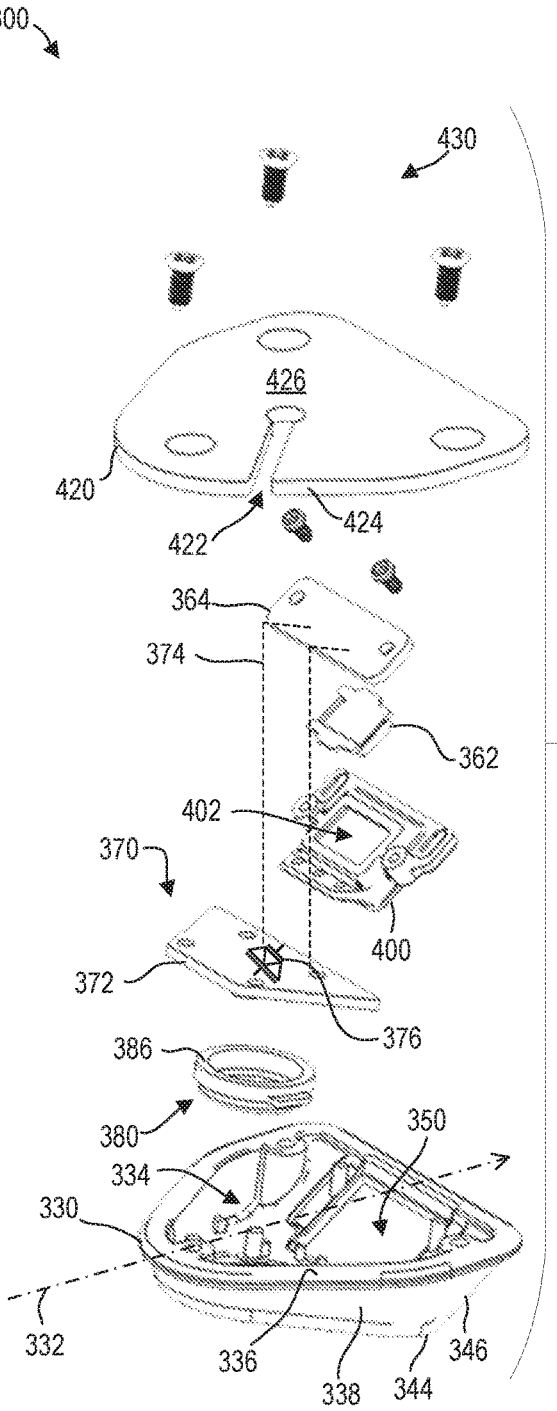
FIG. 12 is an upper perspective exploded view of the light module of FIG. 10 showing upper portions of various components of the light module.
Figure 13:
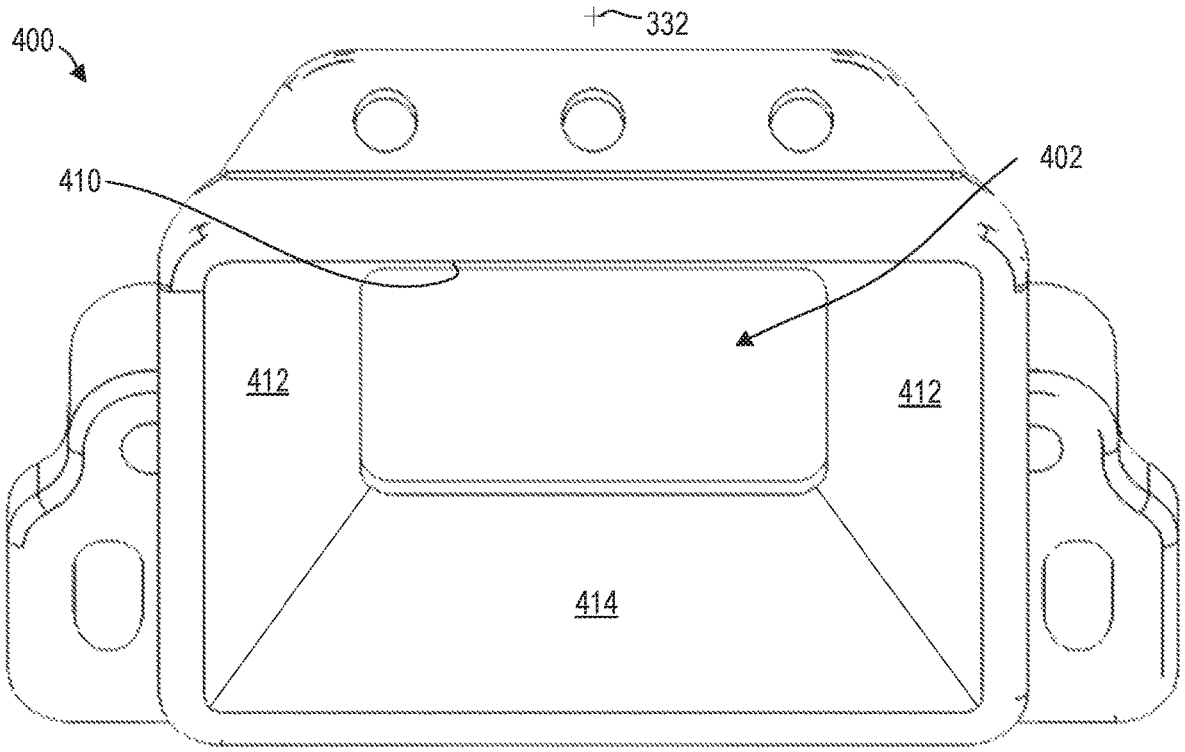
FIG. 13 is a front elevation view of the light module of FIG. 10 showing reflector walls extending from a rearward opening of the reflector.
Figure 14:
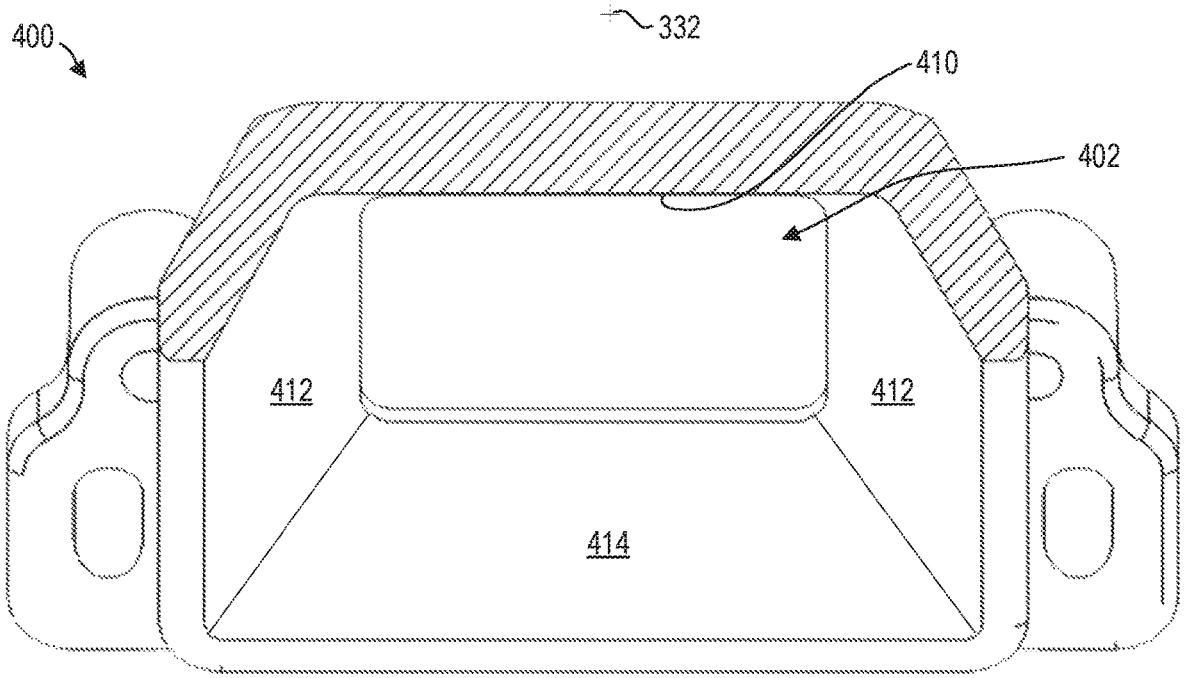
FIG. 14 is a cross-sectional view of FIG. 13 showing the inclination of the opposing reflective side walls relative to the reflective upper wall.

Referring to FIGS. 11 and 12, the light module 320 includes a housing 330. The housing 330 has a central axis 332 that extends in a generally forward direction. The central axis 332 extends, for example, through or along a base flange 336 of the housing 330.

The housing 330 includes housing walls that extend from the base flange 336, and extend about a housing interior 334. The housing walls may generally define a wedge-shaped housing. In this regard, the housing walls include a lower wall portion 340, an upper wall portion 342, and opposing side walls 338 that extend between the base flange 336 and the lower wall portion 340 and upper wall portion 342. In one approach, a side wall 338 has a rearward side wall portion that forms a rearward curved or rounded side interface with the upper wall portion 342, and a forward side wall portion that forms a forward curved or rounded side interface with the lower wall portion 340.

The lower wall portion 340 and the upper wall portion 342 converge to form an apex 344 of the housing 330. In one aspect, the apex 344 is a curved or rounded apex.

The lower wall portion 340 includes one or more opposite sections, referred to herein as side wall portions 346, that at least partially define an opening. For example, two opposing side wall portions 346 cooperate to at least partially form a lower opening 350, also referred to herein as a large light opening, therebetween.

The lower opening 350 has a lateral width (e.g., in a direction orthogonal to the central axis 332) that is larger than a lateral width of at least one of the side wall portions 346. In one aspect, the lateral width of the lower opening 350 is larger than the lateral width of one of the opposite side wall portions 346, but smaller than a combined lateral width of the lateral widths of both of the opposite side wall portions 346. For example, each side wall portion 346 may have a lateral width of approximately 0.27 inches such that the side wall portions 346 have a combined lateral width of approximately 0.54 inches, and the lower opening 350 may have a lateral width of approximately 0.53 inches.

In still another aspect, the lateral width of the lower opening 350 is larger than a combined lateral width of the lateral widths of both of the opposite side wall portions 346. For example, each side wall portion 346 may have a lateral width of approximately 0.25 inches such that the side wall portions 346 have a combined lateral width of approximately 0.5 inches, and the lower opening 350 may have a lateral width of approximately 0.53 inches.

The upper wall portion 342 has a generally planar wall portion that includes an actuator hole 352. As discussed in greater detail elsewhere herein, the actuator hole 352 is sized to receive a user-actuatable actuator, such as a push-button.

In the approach shown, the lower wall portion 340 is a lower inclined wall portion, and the upper wall portion 342 is an upper inclined wall portion.

The light module 320 further includes a light source 360 that is mounted at least partially within the housing interior 334. The light source 360 may provide illumination outwardly from the housing 330; for example, through the lower opening 350. In one aspect, the light source 360 includes a single LED. In another aspect, the light source 360 includes a plurality of LEDs. A cover or lens 362 may extend across the LED portion of the light source 360.

The light module 320 also includes a switch device 370. The switch device 370 is electrically coupled to the light source 360 and the power source 322 for selectively energizing the light source 360. The switch device 370 includes, for example, a circuit board 372 and an actuator 380. The circuit board 372, which may be a printed circuit board (PCB) that includes electrical circuitry 376, is electrically coupled to the light source 360, as indicated at coupling 374.

The actuator 380 includes a plunger housing 382 that is secured to the circuit board 372. The actuator 380 further includes a plunger 384 that is movable within the plunger housing 382. The actuator 380 further includes a resilient button 386 that extends over the plunger 384. The resilient button 386 may have tactile indicia 388, such as one or both of a depression and a protrusion. In this way, the tactile indicia 388 may provide a user with tactile feedback indicating the user's finger has engaged the resilient button 386.

The light module 320 further includes a heat sink member 364. The heat sink member 364 is formed of, or includes, conductive material. More particularly, the heat sink member 364 is formed of a material with high thermal conductivity, such as an aluminum alloy. As such, the heat sink member 364 may have a thermal conductivity value of between about 120 W/mK to about 240 W/mK to conduct heat away from the light source 360 during operation of the light module 320. The heat conduction by the heat sink member 364 reduces the risk of damaging components of the light module 320 through overheating. In the illustrated and preferred form, the heat sink member 364 has a generally rectangular body. Although depicted as having a single heat sink member 364, the light module 320 may be provided with two or more heat sink members.

In the assembled configuration, the heat sink member 364 is electrically coupled to the circuit board 372, and the light source 360 is secured to a heat sink member 364. More particularly, the heat sink member 364 is disposed between the light source 360 and the circuit board 372 such that the light source 360 is separated from the circuit board 372 by the heat sink member 364. As shown, the heat sink member 364 may be installed in an inclined orientation. The inclination of the heat sink member 364 generally corresponds to that of the lower wall portion 340. In this way, the heat sink member 364 extends generally parallel to the lower wall portion 340.

The light module 320 further includes a reflector 400. The reflector 400 is a discrete reflector that is mounted (e.g., removably mounted) to the housing 330 within the housing interior 334. More particularly, the reflector 400 is mounted at the lower opening 350 of the housing 330. The reflector 400 includes a rearward opening 402 that is aligned with the light source 360 to permit light emitted from the light source 360 to pass therethrough. The reflector 400 includes a plurality of reflective walls that may extend generally forwardly and outwardly from the rearward opening 402 to the lower opening 350 (e.g., into engagement with the housing 330). As used herein, a generally forward direction may refer to the forward direction along axis 332, and a generally outward direction may refer to a direction generally away from a central axis of light source 360. As such, the light source 360 may emit light in a direction that is generally forward and generally downward from the light module 320.

Referring to FIGS. 11-14, the plurality of reflective walls include, for example, a reflective upper wall 410. The reflective upper wall 410 may extend generally forwardly from the rearward opening 402. As such, light emitted through the lower opening 350 is reflected generally downwardly and/or generally forwardly.

The plurality of reflective walls further includes one or more reflective side walls. For example, the reflector 400 includes a pair of opposing reflective side walls 412. The reflective upper wall 410 may extend between the opposing reflective side walls 412. The opposing reflective side walls 412 may taper away from each other as the opposing reflective side walls 412 extend away from the rearward opening 402. In one aspect, the reflective upper wall 410 and each of the opposing reflective side walls 412 extend equidistant from the rearward opening 402 to the lower opening 350.

The plurality of reflective walls further includes a reflective lower wall 414. The reflective lower wall 414 may extend generally forwardly from the rearward opening 402 to the lower opening 350. In one aspect, the reflective lower wall 414 and the reflective upper wall 410 extend equidistant from the rearward opening 402 to the lower opening 350. In another aspect, the reflective upper wall 410 extends a greater distance from the rearward opening 402 to the lower opening 350.

Referring again to FIGS. 11 and 12, the light module 320 further includes a backplate or mounting plate 420. The mounting plate 420 is securable to the housing 330, or vice versa. The mounting plate 420 may include a guide slot 422 that extends through the mounting plate 420; for example, through an entire thickness of the mounting plate 420. The guide slot 422 may extend from an outer periphery 424 (e.g., an outer peripheral edge) of the mounting plate 420 to a central region 426 of the mounting plate 420. The guide slot 422 is sized to receive an electrical connection therein (e.g., electrical connection 324 of FIG. 10). As such, the electrical connection 324 may extend from the power source 322, through the guide slot 422 of the mounting plate 420, into the housing interior 334, and to the switch device 370.

One or more fasteners 430 are provided for securing housing 330 to the mounting plate 420. Similarly, one or more fasteners 432 are provided for securing the heat sink member 364 to the reflector 400. The fasteners 430 may be, for example, threaded fasteners, rivets, or the like.

Figure 15:
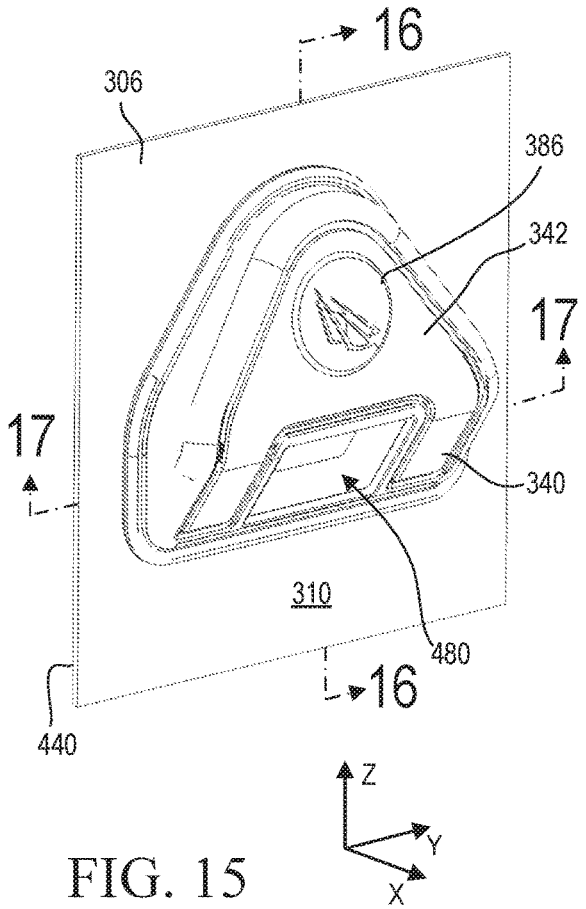
FIG. 15 is an enlarged perspective view of the light module of FIG. 10 showing a portion of the beanie-style lighted cap extending between the housing and the mounting plate of the light module.
Figure 16:
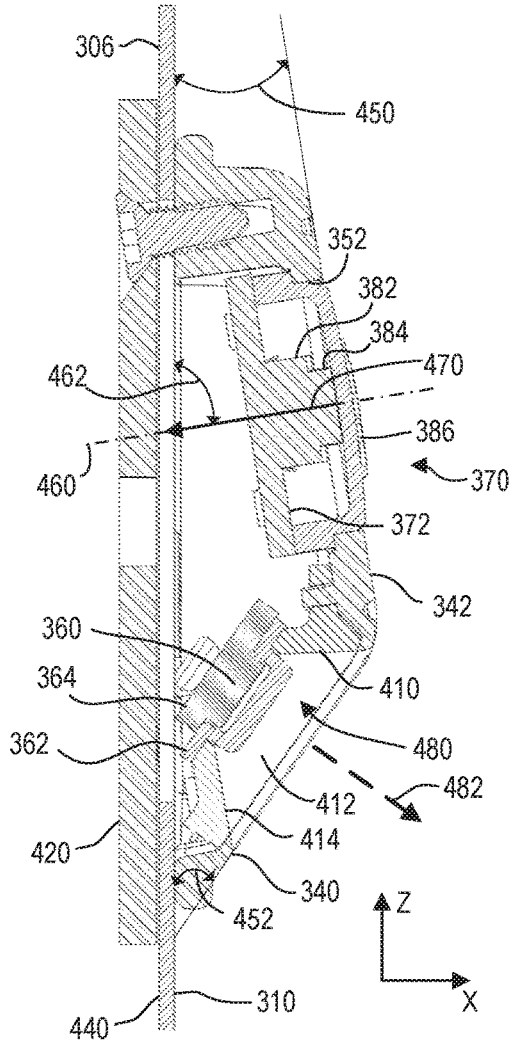
FIG. 16 is a cross-sectional view taken along the line 16-16 of FIG. 15 showing inclinations of various components of the light module.
Figure 17:
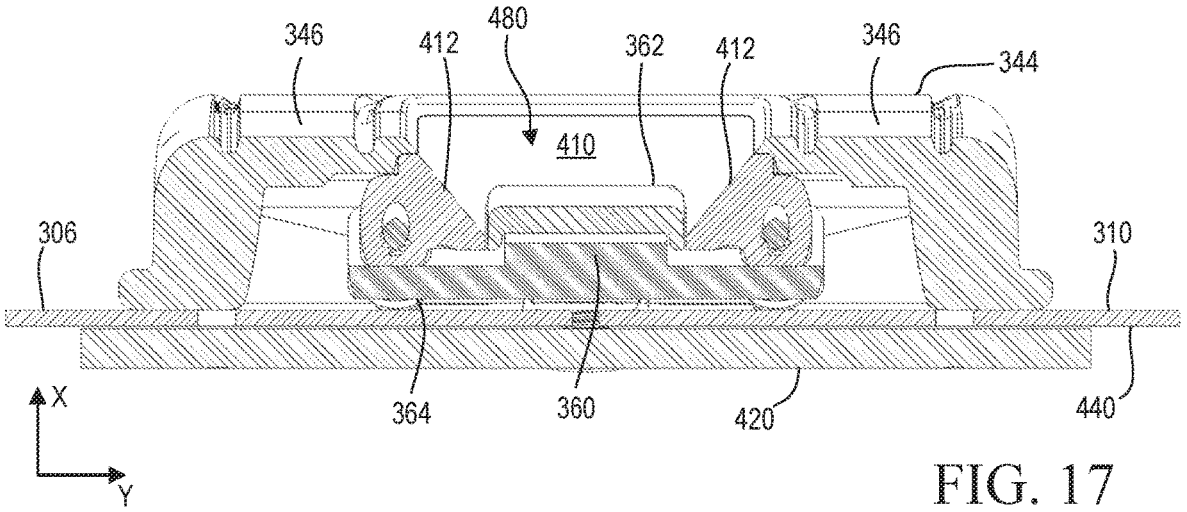
FIG. 17 is a cross-sectional view taken along the line 17-17 of FIG. 15 showing inclinations of various components of the light module.

Referring to FIGS. 15-17, in an assembled configuration, the mounting plate 420 is disposed at a rearward-facing surface 440 of the annular portion 306 (e.g., at the cap band 308), and the housing 330 is disposed at the forwardly-facing surface 310 of the cap band 308. The housing 330 is secured to the mounting plate 420 such that at least a portion of the head-fitting portion (e.g., annular portion 306) extends between and in engagement with the mounting plate 420 and the housing 330.

One or both of the upper wall portion 342 and the lower wall portion 340 may be inclined relative to the central axis 332. In one aspect, the upper wall portion 342 extends at an oblique angle 450 relative to the cap band 308 (e.g., relative to the forwardly-facing surface 310 of the cap band 308) such that the upper wall portion 342 tapers away from the forwardly-facing surface 310 as the upper wall portion 342 extends downwardly (e.g., along the Z axis of FIG. 16). The oblique angle 180 may be, for example, an acute angle in the range of approximately (e.g., +/−3 degrees) 5 degrees to approximately 45 degrees, and more particularly, is approximately 10 degrees.

The lower wall portion 340 may also or may instead extend at an oblique angle 452 relative to the cap band 308 (e.g., relative to the forwardly-facing surface 310 of the cap band 308). In this way, the lower wall portion 340 includes a lower inclined wall portion inclined obliquely relative to the forwardly-facing surface 310 to taper toward the forwardly-facing surface 310 as the lower inclined wall portion extends downwardly (e.g., along the Z axis of FIG. 16).

The actuator 380 of the switch device 370 is associated with the upper wall portion 342. More particularly, the resilient button 386 of the actuator 380 is received in the actuator hole 352 of the upper wall portion 342. The actuator hole 352 includes a central hole axis 460 that intersects the forwardly-facing surface 310 of the cap band 308 at an oblique angle 462.

The actuator 380 is configured to travel in a linear actuation direction 470 when pushed by the user. During actuation, the resilient button 386 is deformed by the user to depress the plunger 384 in the linear actuation direction 470, which is arranged to be downwardly and rearwardly relative to the generally forwardly-facing surface 310 of the cap band 308 for ease of operation by the user.

The reflector 400 cooperates with the housing 330 to at least partially form a recessed light opening 480 of the light module 320. As such, light emitted from the light source 360 is oriented in a direction 482 that is generally forward and downward from the light module 320. In this way, an area that is forward and generally downward from the lighted hat 10 is illuminated.

Referring to FIGS. 18-22, a battery holder 500 is shown. The battery holder 500 may be used for the power source 52 of FIGS. 1 and 2, and/or the power source 322 of FIG. 10.

The battery holder 500 includes a frame assembly 502 that includes a first end cover 504 and a second end cover 506. The first end cover 504 includes a first battery contact element 510 that includes a first pair of battery contact elements. In one aspect, the first battery contact element 510 is a unitary conversion plate (e.g., a positive-negative conversion spring contact plate). In another aspect, the first battery contact element 510 includes discrete positive and negative contacts.

Similarly, the second end cover 506 includes a second battery contact element 512 that includes a second pair of battery contact elements. In one aspect, the second battery contact element 512 is a unitary conversion plate (e.g., a positive-negative conversion spring contact plate). In another aspect, the second battery contact element 512 includes discrete positive and negative contacts.

The battery holder 500 includes a wiring hub 520 that extends from the frame assembly 502; for example, from a lower region of the first end cover 504. The wiring hub 520 may guide an electrical connection 522 extending from the frame assembly 502. The electrical connection may generally correspond to the electrical connection 54 of FIGS. 1 and 2 and/or the electrical connection 324 of FIG. 10.

Figure 22:
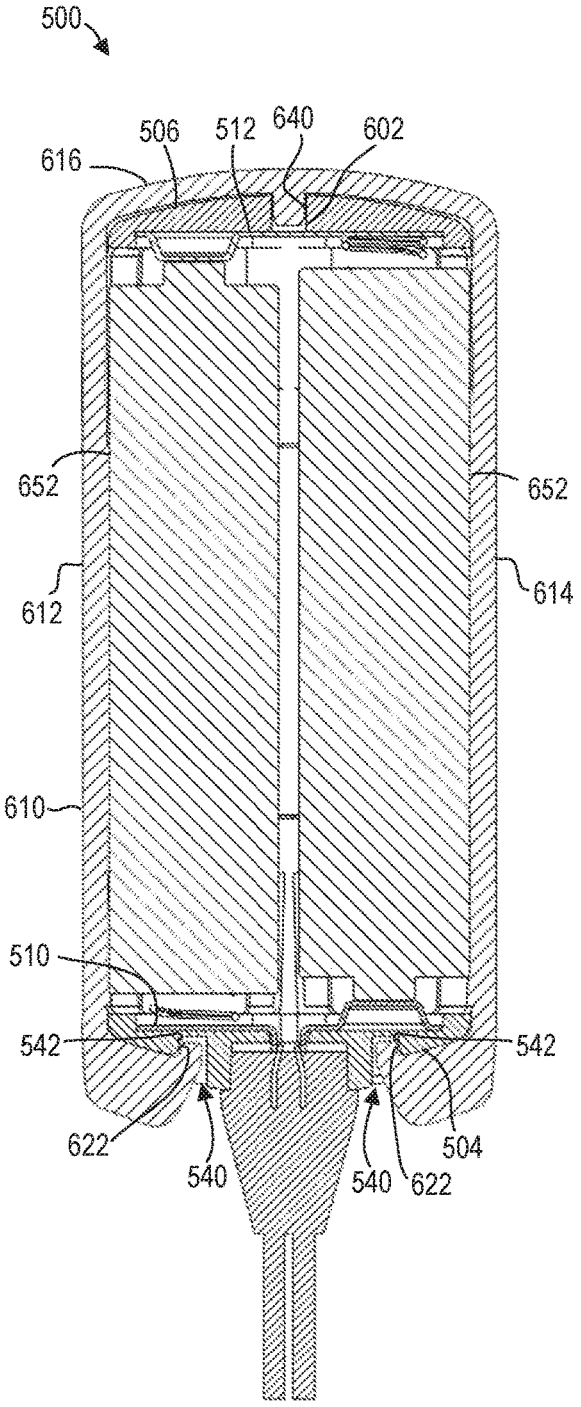
FIG. 22 is a cross-sectional view of the reflector of FIG. 18 in an assembled configuration.

As shown in FIGS. 19 and 22, the first end cover 504 includes laterally-extending channels 530 extending along an end surface 532 of the first end cover 504. The laterally-extending channels 530 are defined by at least laterally-extending sidewalls of the first end cover 504. More particularly, in the approach shown, the laterally-extending channels 530 are defined by laterally-extending sidewalls and a laterally-extending upper wall.

A laterally-extending channel 530 includes a recess 540. For example, the two recesses shown in FIG. 19 may extend longitudinally from the end surface 532 a greater distance than the laterally-extending sidewalls of the laterally-extending channel 530. In this way, each recess 540 defines an abutment surface 542, which may be a side wall of a recess 540. In one aspect, the wiring hub 520 extends from the end surface 532 of the first end cover 504 between the recesses 540.

Referring to FIG. 20, the first end cover 504 further includes longitudinally-extending channels 550. The longitudinally-extending channels 550 may extend from the laterally-extending channels 530 at side end portions 552 of the first end cover 504. A longitudinally-extending channel 550 is defined between side prongs 554 that extend longitudinally from a base portion 556 of the first end cover 504. A longitudinally-extending channel 550 is contiguous with a corresponding laterally-extending channel 530 to define a contiguous side channel in the first end cover 504.

The side prongs 554 include generally curved interior surfaces that face in the general direction of a central axis 560 of the battery holder 500. The generally curved interior surfaces are dimensioned to interface (e.g., retain or secure) a cylindrical battery.

The first end cover 504 further includes intermediate prongs 570 that extend longitudinally from the base portion 556 of the first end cover 504 between corresponding side prongs 554. The intermediate prongs 570 include generally curved interior surfaces that face in the general direction the generally curved interior surfaces of the side prongs 554. The intermediate prongs 570 cooperate with a first set of side prongs 554 at one side of the first end cover 504 to form a first portion of a battery lower compartment therebetween, and cooperate with a second set of side prongs 554 at an opposite side of the first end cover 504 to form a second portion of the lower battery compartment therebetween.

The second end cover 506 includes a laterally-extending channel 580 extending along an end surface 582 of the second end cover 506. In one aspect, the laterally extending channel 580 extends along an entire lateral length of the end surface 582. The second end cover 506 further includes longitudinally-extending channels 590. The longitudinally-extending channels 590 may extend from the laterally-extending channel 580 at side end portions 592 of the second end cover 506. A longitudinally-extending channel 550 is defined between side prongs 594 that extend longitudinally from a base portion 596 of the second end cover 506. A longitudinally-extending channel 590 is contiguous with the laterally-extending channel 580 to define a contiguous side channel in the second end cover 506.

The side prongs 594 include generally curved interior surfaces that face in the general direction of the central axis 560 of the battery holder 500. The generally curved interior surfaces is dimensioned to interface (e.g., retain or secure) a cylindrical battery.

The second end cover 506 further includes intermediate prongs 600 that extend longitudinally from the base portion 596 of the second end cover 506 between corresponding side prongs 594. The intermediate prongs 600 include generally curved interior surfaces that face in the general direction the generally curved interior surfaces of the side prongs 594. The intermediate prongs 600 may cooperate with a first set of side prongs 594 at one side of the second end cover 506 to form a first portion of an upper battery compartment therebetween, and may cooperate with a second set of side prongs 594 at an opposite side of the second end cover 506 to form a second portion of the upper battery compartment therebetween.

The second end cover 506 further includes a hole 602. The hole 602 may be a through-hole or a blind hole that is disposed in the base portion 596 of the second end cover 506; for example, within the laterally-extending channel 580.

The battery holder 500 includes a resilient clip member 610. The resilient clip member 610 may be a component of the frame assembly 502. In one aspect, the resilient clip member 610 is a detachable resilient clip member. As shown, the resilient clip member 610 has a generally U-shaped configuration. In another aspect, the resilient clip member 610 is an integrally-formed resilient clip member that is integrally formed, for example, with the first end cover 504 or the second end cover 506.

The resilient clip member 610 includes a first resilient arm 612, a second resilient arm 614, and a base portion 616 that extends between the first resilient arm 612 and the second resilient arm 614 to interconnect the first resilient arm 612 and the second resilient arm 614. The first resilient arm 612 is an elongated arm that extends from the base portion 616 to a first free end portion 620. The first free end portion 620 includes a first latching hook 622. The first latching hook 622 may extend from the first free end portion 620 in the general direction of the base portion 616. Additionally or alternatively, the first free end portion 620 includes a first release tab 624. The first release tab 624 extends from the first free end portion 620 in a direction generally opposite the base portion 616 (e.g., opposite the first latching hook 622). The first release tab 624 may assist a user in manipulating the first resilient arm 612 (e.g., from an assembled or latched configuration to an unassembled or unlatch configuration).

Similarly, the second resilient arm 614 is an elongated arm that extends from the base portion 616 to a second free end portion 630. The second free end portion 630 includes a second latching hook 632. The second latching hook 622 extends from the second free end portion 630 in the general direction of the base portion 616. Additionally or alternatively, the second free end portion 630 includes a second release tab 634. The second release tab 634 extends from the second free end portion 630 in a direction generally opposite the base portion 616 (e.g., opposite the second latching hook 632). The second release tab 634 may assist a user in manipulating the second resilient arm 614 (e.g., from an assembled or latched configuration to an unassembled or unlatch configuration).

The resilient clip member 610 further includes a guide peg 640. The guide peg 640 is provided, for example, at an interior surface of the base portion 616. The guide peg 640 is dimensioned to be received within the hole 602 of the second end cover 506. In this way, the guide peg 640 and the hole 602 may cooperate to assist a user in aligning the resilient clip member 610 with the second end cover 506. In another aspect, the second end cover 506 is provided with a guide peg, and the resilient clip member 610 is provided with a hole to assist a user in aligning the resilient clip member 610 with the second end cover 506.

The battery holder 500 is depicted in an unassembled configuration in FIGS. 18-20. In the unassembled configuration, one or both of the first free end portion 620 and the second free end portion 630 are disengaged from the first end cover 504. Also in the unassembled configuration, the first and second resilient arms 612, 614 are outwardly divergent. That is, the first and second resilient arms 612, 614 taper away from each as they extend along the central axis 560 away from the base portion 616.

Figure 21:
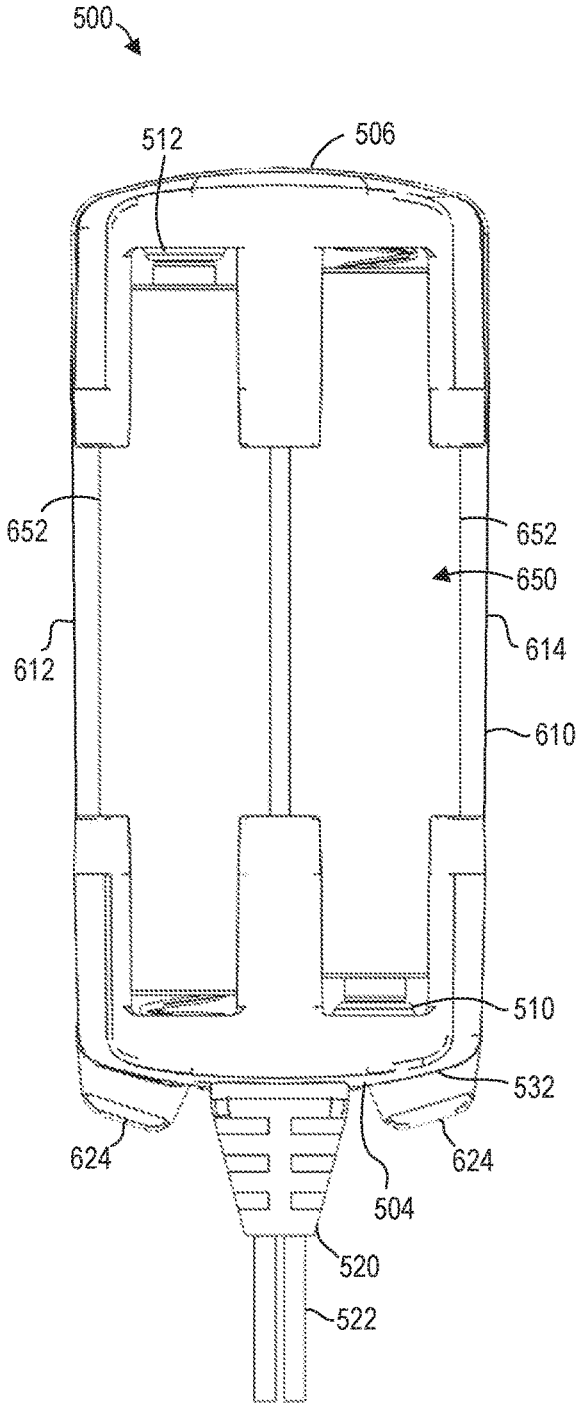
FIG. 21 is a front elevation view of the battery holder of FIG. 18 in an assembled configuration.

Referring to FIGS. 21 and 22, the battery holder 500 is depicted in an assembled configuration. In the assembled configuration, the first and second resilient arms 612, 614 extend from the second end cover 506 to the first end cover 504 such that the free end portions 620, 630 engage the first end cover 504 to releasably secure the second end cover 506 to the first end cover 504. Also in the assembled configuration, the first end cover 504, the second end cover 506, and the first and second resilient arms 612, 614 cooperate to define at least one substantially open battery compartment 650. In one aspect, the battery compartment 650 is dimensioned to receive a single battery 652. In another aspect, the battery compartment 650 is dimensioned to receive a plurality of batteries, such as two batteries 652. The one or more batteries 652 may be cylindrical batteries disposed longitudinally between the first and second battery contact elements 510, 512 and laterally between the first and second resilient arms 612, 614.

Also in the assembled configuration, the base portion 616 is at least partially received within the laterally-extending channel 580 of the second end cover 506. In one aspect, the base portion 616 is received within the laterally-extending channel 580 such that an outwardly-facing surface of the base portion 616 is flush, or substantially flush, with an outwardly-facing surface of the end surface 582 of the second end cover 506. Furthermore, the first and second resilient arms 612, 614 are at least partially received within the longitudinally-extending channels 590 of the second end cover 506. In one aspect, the first and second resilient arms 612, 614 are received within the longitudinally-extending channels 590 such that outwardly-facing surfaces of the first and second resilient arms 612, 614 are flush, or substantially flush, with outwardly-facing surfaces of side end portions 592 of the second end cover 506.

The first and second resilient arms 612, 614 extend longitudinally along the battery compartment 650 (including along batteries 652, if installed) toward the first end cover 504. The first and second resilient arms 612, 614 are at least partially received within the longitudinally-extending channels 550 of the first end cover 504. In one aspect, the first and second resilient arms 612, 614 are received within the longitudinally-extending channels 550 such that outwardly-facing surfaces of the first and second resilient arms 612, 614 are flush, or substantially flush, with outwardly-facing surfaces of side end portions 552 of the first end cover 504. As such, in the assembled configuration, the first and second resilient arms 612, 614 are generally parallel. The free end portions 620, 630 are at least partially received within the laterally-extending channels 530 that extend along the end surface 532 of the first end cover 504.

The first and second latching hooks 622, 632 are adapted to secure the second end cover 506 to the first end cover 504 via the first and second resilient arms 612, 614. More particularly, the first and second latching hooks 622, 632 extend into the recesses 540 of the first end cover 504 and into engagement with the abutment surfaces 542 formed in the recesses 540. Upon engagement, lateral movement of the free end portions 620, 630 (e.g., in a direction substantially orthogonal to the central axis 560) is substantially inhibited. Furthermore, one or both of the first and second battery contact elements 510, 512 includes a spring that imparts a longitudinally-biasing force through the one or more batteries 652 that biases the first and second end covers 504, 506 in opposite directions. Such opposing longitudinally-biasing forces act to retain the free end portions 620, 630 of the first and second resilient arms 612, 614 within the laterally-extending channels 530 of the first end cover 504.

As such, in the assembled configuration, the free end portions 620, 630 of the first and second resilient arms 612, 614 engage the abutment surfaces 542 to releasably secure the second end cover 506 to the first end cover 504. The resilient clip member 610 interfaces the various laterally-extending and longitudinally-extending channels of the first and second end covers 504, 506 to provide a low profile battery holder 500.

In the approach shown, the battery holder 500 includes first and second substantially open side-by-side compartments that are sized and shaped to fixedly retain first and second cylindrical-shaped batteries 652. The first and second end covers 504, 506 are disposed opposite to each other and spaced apart at the opposite ends of the frame assembly 502 such that the first and second batteries 652 are securely engaged with corresponding ones of the contact elements and are not fully enclosed by the frame assembly 502.

As discussed, the free end portions 620, 630 are provided with release tabs 624, 634 to assist a user in manipulating the first and second resilient arms 612, 614 (e.g., from the assembled or latched configuration to an unassembled or unlatch configuration). In this way, the resilient clip member 610 is configured to releasably connect the first and second end covers 504, 506 together to form the frame assembly 502, and to allow the first and second end covers 504, 506 covers to be disconnected from each other for removal and replacement of the batteries 652.

Although depicted as a discrete, detachable resilient clip member 610, one or more portions of the resilient clip member 610 may be integrated with first end cover 504, the second end cover 506, or a combination of the first end cover 504 and the second end cover 506. For example, the resilient clip member 610 may be integrally formed with the second end cover 506 such that the second end cover 506 includes integrally-formed elongated resilient arms.

While exemplary embodiments are described above, it is not intended that these embodiments describe all possible forms encompassed by the claims. The words used in the specification are words of description rather than limitation, and it is understood that various changes is made without departing from the spirit and scope of the disclosure. As previously described, the features of various embodiments is combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics is compromised to achieve desired overall system attributes, which depend on the specific application and implementation. These attributes may include, but are not limited to cost, strength, durability, life cycle cost, marketability, appearance, packaging, size, serviceability, weight, manufacturability, ease of assembly, etc. As such, embodiments described as less desirable than other embodiments or prior art implementations with respect to one or more characteristics are not outside the scope of the disclosure and is desirable for particular applications.

What is claimed is:

1. A light module for mounting to an article of clothing, the light module comprising:

a housing having an interior;

a light source mounted in the interior;

an inclined forward wall portion of the housing having a large light opening through which light from the light source is emitted;

opposite inclined wall sections of the inclined forward wall portion laterally spaced from each other on either side of the large light opening, with the large light opening having a maximum lateral width that is larger than a maximum lateral width of at least one of the opposite inclined wall sections of the inclined forward wall portion;

a switch device electrically coupled to the light source and having an actuator operable to switch the light source between on and off states; and a rearward wall portion of the housing extending obliquely to the inclined forward wall portion and having an actuator opening in which a user-operated portion of the actuator is received.

2. The light module of claim 1 further comprising a backplate for mounting adjacent the article of clothing, wherein the inclined forward wall portion is inclined obliquely relative to the backplate.

3. The light module of claim 1 wherein a lateral width of the large light opening varies from a minimum lateral width proximate to the light source to the maximum lateral width distal from the light source.

4. The light module of claim 1 wherein at least one opposite inclined wall section tapers outwardly from a central axis of the light source as the at least one opposite inclined wall section extends away from the rearward wall portion.

5. The light module of claim 1 wherein the inclined forward wall portion and the rearward wall portion are joined to each other to form an obtuse angle therebetween within the housing.

6. The light module of claim 1 further comprising a reflector secured to the housing, the reflector including a rearward opening aligned with the light source and at least one reflective wall extending forwardly from the rearward opening.

7. The light module of claim 6 wherein the reflector includes a first reflective wall, a second reflective wall, and a pair of opposing reflective side walls extending between the first and second reflective walls for reflecting light from the light source.

8. The light module of claim 7 wherein the first reflective wall extends forwardly from the rearward opening farther than the second reflective wall.

9. The light module of claim 7 wherein the pair of opposing reflective side walls extend forwardly from the rearward opening farther than the second reflective wall.

10. The light module of claim 7 wherein the pair of opposing reflective side walls taper outwardly from a central axis of the light source as the pair of opposing reflective side walls extend forwardly from the rearward.

11. The light module of claim 7 wherein the pair of opposing reflective side walls are inclined relative to the first reflective wall to form obtuse angles with the first reflective wall.

12. A light module comprising:

a housing having an interior;

a light source mounted in the interior;

a first inclined wall portion including an opening configured to permit light generated by the light source to pass therethrough;

a second inclined wall portion having a user-operated actuator interface, and a switch device electrically coupled to the light source for selectively energizing the light source, the switch device having an actuator associated with the second inclined wall portion and being configured to travel in a linear actuation direction when pushed by a user, the linear actuation direction being arranged to be generally oblique relative to the first inclined wall portion for ease of operation by the user.

13. The light module of claim 12 further comprising a backplate for mounting adjacent an article of clothing, wherein the first inclined wall portion is inclined obliquely relative to the backplate.

14. The light module of claim 12 further comprising a reflector secured to the housing, the reflector including a rearward opening aligned with the light source and at least one reflective wall extending forwardly from the rearward opening.

15. The light module of claim 14 wherein the reflector includes a first reflective wall and a second reflective wall that tapers away from the first reflective wall as the second reflective wall extends away from the rearward opening.

16. The light module of claim 14 wherein the reflector includes a first reflective wall and a pair of opposing reflective side walls that extend from the first reflective wall and taper away from each other as the pair of opposing reflective side walls extend away from the rearward opening.

17. The light module of claim 12 wherein the switch device includes an inclined circuit board is mounted in the housing to extend obliquely relative to the first inclined wall portion, the inclined circuit board being electrically coupled to the light source and the switch device.

18. A light module comprising:

a housing including a mounting surface having a fore-and-aft axis, an inclined wall portion that extends obliquely relative to the mounting surface and that includes a light opening, and an actuator wall portion that extends obliquely relative to the inclined wall portion;

a light source mounted in the housing to direct light through the light opening; and a switch device electrically coupled to the light source for selectively energizing the light source, the switch device having an actuator associated with the actuator wall portion and being configured to travel in a linear actuation direction when pushed by a user, the linear actuation direction being arranged to be oblique to the inclined wall portion.

19. The light module of claim 18 wherein the inclined wall portion and the actuator wall portion are joined to each other to form an obtuse angle therebetween within the housing.

20. The light module of claim 18 wherein the inclined wall portion and the actuator wall portion each have a generally planar configuration.

21. The light module of claim 18 further comprising a reflector secured to the housing, the reflector including a rearward opening aligned with the light source and at least one reflective wall extending forwardly from the rearward opening.

22. The light module of claim 21 wherein the reflector includes a plurality of reflective walls having corner junctures therebetween, the plurality of reflective walls including a first reflective wall, a second reflective wall, and a pair of opposing reflective side walls extending between the first and second reflective walls for reflecting light from the light source.

23. The light module of claim 18 wherein the linear actuation direction is oblique to a central axis of the light source.

24. The light module of claim 18 wherein the light module is configured to be secured to headgear.

25. The light module of claim 24 in combination with the headgear, wherein the headgear includes a head-fitting portion and a brim portion extending generally forwardly from the head-fitting portion, wherein the mounting surface is arranged to be adjacent the brim portion.

26. The light module of claim 24 in combination with the headgear, wherein the headgear includes a head-fitting portion having a forwardly-facing surface when worn, wherein the mounting surface is arranged to be adjacent the forwardly-facing surface.

27. The light module of claim 26 wherein the headgear is a beanie-style cap.

28. Lighted headgear comprising:

a head fitting portion for fitting on a head of a user;

a brim portion that extends in a generally forward direction from the head fitting portion, the brim portion having a generally downwardly-facing surface and including a central axis that extends in the generally forward direction; and a light module mounted to the generally downwardly-facing surface of the brim portion, the light module including:

a housing having a forward wall portion that includes a forward opening, and a rearward wall portion that extends obliquely relative to the forward wall portion, a light source mounted in the housing to direct light through the forward opening, and a switch device electrically coupled to the light source for selectively energizing the light source, the switch device having an actuator associated with the rearward wall portion and being configured to travel in a linear actuation direction when pushed by the user, the linear actuation direction being arranged to be upwardly relative to the generally downwardly-facing surface of the brim portion for ease of operation by the user.

29. The lighted headgear of claim 28 wherein the light source emits light in a direction that is generally forwardly and downwardly from the light module.

30. The lighted headgear of claim 28 wherein the actuator includes a resilient button and a plunger, and the rearward wall portion has an opening for receiving the resilient button, the resilient button being deformable by the user to depress the plunger in the linear actuation direction.

31. The lighted headgear of claim 28 wherein the rearward wall portion is an inclined rearward wall portion that extends obliquely relative to the central axis.

32. The lighted headgear of claim 28 wherein the linear actuation direction is arranged to be upwardly and forwardly relative to the generally downwardly-facing surface of the brim portion.

* * * * *